US010837750B2

(12) United States Patent
Averett et al.

(10) Patent No.: US 10,837,750 B2
(45) Date of Patent: Nov. 17, 2020

(54) SYSTEMS FOR AUTOMATED LOADING OF BLASTHOLES AND METHODS RELATED THERETO

(71) Applicant: Dyno Nobel Inc., Salt Lake City, UT (US)

(72) Inventors: Jeff Averett, Salt Lake City, UT (US); Scott Giltner, Salt Lake City, UT (US); Patrick O'Connor, Lynbrook, NY (US)

(73) Assignee: Dyno Nobel Inc., Salt Lake City, UT (US)

( * ) Notice: Subject to any disclaimer, the term of this patent is extended or adjusted under 35 U.S.C. 154(b) by 0 days.

(21) Appl. No.: 16/260,607

(22) Filed: Jan. 29, 2019

(65) Prior Publication Data

US 2019/0234722 A1 Aug. 1, 2019

Related U.S. Application Data

(60) Provisional application No. 62/782,917, filed on Dec. 20, 2018, provisional application No. 62/623,094, filed on Jan. 29, 2018.

(51) Int. Cl.
*F42D 1/10* (2006.01)
*F42D 3/04* (2006.01)

(52) U.S. Cl.
CPC *F42D 1/10* (2013.01); *F42D 3/04* (2013.01)

(58) Field of Classification Search
USPC ..... 102/313
See application file for complete search history.

(56) References Cited

U.S. PATENT DOCUMENTS

| | | | |
|---|---|---|---|
| 3,735,704 | A | 5/1973 | Livingston |
| 4,223,399 | A | 9/1980 | Hackett |
| 4,468,762 | A | 8/1984 | Jurgens |
| 4,991,684 | A | 2/1991 | Mitchell |
| 5,584,222 | A | 12/1996 | Engsbratten et al. |
| 6,035,784 | A | 3/2000 | Watson |
| 6,125,761 | A | 10/2000 | Smith, Jr. et al. |
| 6,165,297 | A | 12/2000 | Smith et al. |
| 6,453,818 | B1 | 9/2002 | Brent |
| 6,460,462 | B1 | 10/2002 | Rosenstuck |
| 6,584,406 | B1 | 6/2003 | Harmon et al. |
| 6,759,968 | B2 | 7/2004 | Zierolf |
| 6,957,707 | B2 | 10/2005 | Koivunen et al. |

(Continued)

FOREIGN PATENT DOCUMENTS

| | | |
|---|---|---|
| GB | 2083526 | 3/1982 |
| WO | 2003042626 | 3/2003 |

(Continued)

OTHER PUBLICATIONS

International Search Report and Written Opinion dated May 15, 2019 for PCT/US2019/015604.

(Continued)

*Primary Examiner* — Reginald S Tillman, Jr.
(74) *Attorney, Agent, or Firm* — Stoel Rives LLP

(57) ABSTRACT

Systems for automatedly delivering explosives with variable densities are disclosed herein. Methods of automatedly delivering explosives with variable densities are disclosed herein. Methods of determining an emulsion explosive density profile are disclosed herein.

17 Claims, 17 Drawing Sheets

(56) References Cited

U.S. PATENT DOCUMENTS

| | | | | |
|---|---|---|---|---|
| 7,367,269 | B2 | 5/2008 | La Rosa | |
| 7,418,373 | B2 | 8/2008 | Heck, Sr. | |
| 7,530,311 | B2 | 5/2009 | Koekemoer et al. | |
| 7,578,237 | B2 | 8/2009 | Johnston et al. | |
| 7,654,317 | B2 | 2/2010 | Uitto | |
| 7,752,953 | B2 | 7/2010 | Sokol et al. | |
| 7,911,760 | B2 | 3/2011 | Lownds | |
| 8,011,447 | B2 | 9/2011 | Keniston | |
| 8,256,349 | B2 | 9/2012 | Moore | |
| 8,261,664 | B2 | 9/2012 | Lengeling et al. | |
| 8,315,838 | B2 | 11/2012 | Durrant-Whyte et al. | |
| 8,392,014 | B2 | 3/2013 | Saleniemi et al. | |
| 8,398,175 | B2 | 3/2013 | Spathis et al. | |
| 8,468,944 | B2 | 6/2013 | Givens et al. | |
| 8,538,698 | B2 * | 9/2013 | Heck, Sr. | E21C 37/16 102/301 |
| 8,991,315 | B2 | 3/2015 | Koekemoer et al. | |
| 8,994,515 | B2 | 3/2015 | Guyon et al. | |
| 9,002,648 | B2 | 4/2015 | Pfutzner | |
| 9,127,921 | B2 | 9/2015 | Koekemoer et al. | |
| 9,476,685 | B2 | 10/2016 | Mace et al. | |
| 9,482,507 | B2 | 11/2016 | Thomson et al. | |
| 9,518,454 | B2 | 12/2016 | Current et al. | |
| 9,540,928 | B2 | 1/2017 | Zhou et al. | |
| 9,759,538 | B2 | 9/2017 | Nair | |
| 10,329,890 | B2 * | 6/2019 | Mace | F42B 3/24 |
| 2005/0066836 | A1 | 3/2005 | Levi | |
| 2005/0263027 | A1 | 12/2005 | Johnston et al. | |
| 2009/0250225 | A1 | 10/2009 | Zaeper et al. | |
| 2011/0083574 | A1 | 4/2011 | Levan et al. | |
| 2012/0111559 | A1 | 5/2012 | Deady et al. | |
| 2013/0261873 | A1 | 10/2013 | Pal et al. | |
| 2013/0298795 | A1 | 11/2013 | Brent et al. | |
| 2014/0144342 | A1 | 5/2014 | Bye | |
| 2015/0185715 | A1 | 7/2015 | McHugh | |
| 2016/0290046 | A1 | 10/2016 | Orban et al. | |
| 2016/0313107 | A1 | 10/2016 | Birkin et al. | |
| 2017/0130531 | A1 | 5/2017 | Russell | |
| 2017/0138128 | A1 | 5/2017 | Russell | |
| 2018/0010437 | A1 | 1/2018 | Reid et al. | |

FOREIGN PATENT DOCUMENTS

| | | |
|---|---|---|
| WO | 2003029614 | 4/2003 |
| WO | 2005052499 | 6/2005 |
| WO | 2007096734 | 8/2007 |
| WO | 2010144952 | 12/2010 |
| WO | 2012048368 | 4/2012 |
| WO | 2012068629 | 5/2012 |
| WO | 2013098460 | 7/2013 |
| WO | 2014063188 | 5/2014 |
| WO | 2014123562 | 8/2014 |
| WO | 2017109417 | 6/2017 |

OTHER PUBLICATIONS

Ackermann, et al.,A New Method for Blast-Hole Cutting Analysis, IEEE, IAS/PCA Cement Industry Technical Conference ,May 2009.

Babaei, et al.,Processing of Measurement While Drilling Data for Rock Mass Characterization, International Journal of Mining Science and Technology, vol. 26 Issue 6 ,Nov. 2016 ,989-994.

Bauer, et al.,Optimisation of the Drill and Blast Work in the Open Pit Rabenwald Mine of Rio Tinto Minerals, Loeben ,Feb. 2007.

Bellino, et al.,An Automatic Method for Data Processing of Seismic Data in Tunneling, Journal of Applied Geophysics, No. 98 ,2013 ,243-253.

Eloranta, et al.,Geological Data for Blasting, 1996.

Hutchings, et al.,Drill Monitoring Systems and the Integration with Drill and Blast Software, Datavis Pty. Ltd. and Thunderbird Mining Systems ,2010.

Scheck, et al.,Automated Blast Hole Logging and Design, IFAC Automation in Mining, Mineral and Metal Processing, Helsinki, Finland ,1983.

Vynne, et al.,Drill Monitoring and GPS Developments and Their Impact on the Drill to Mill Process, Thunderbird Mining Systems, Redmond, WA, USA ,1999.

Dyno Nobel's Differential Energy System Provides Blast Benefits, E&MJ ,2017.

Anderson, et al.,Blasthole Burden Design Introducing a Formula, AusIMM Trans ,1952 ,166-7.

Basseville, et al.,Design and Comparative Study of Some Sequential Jump Detection Algorithms for Digital Signals, IEEE Transactions on Acoustics, Speech Processing, vol. ASSP-31 No. 3 ,Jun. 1983.

Segui, et al.,Blast Design Using Measurement While Drilling Parameters, Fragblast: International Journal for Blasting and Fragmentation, vol. 6 No. 3-4 ,2002.

Moghaddamjoo, et al.,Constraint Optimum Well-Log Signal Segmentation, IEEE Transactions of Geoscience and Remote Sensing, 27(5) ,1989 ,633-641.

Paulson, et al.,Review of Characterization and Assessment of Rock Mass Blastability—An Update, 1 School of Geosciences Bharathidasan University ,Nov. 2012.

Shestakov, et al.,An Approach to Evaluation of Strength Characteristics of Roaks in Boreholes, Journal of Mining Science, vol. 34 No. 2 ,1998.

Piyush, et al.,Measurement-While-Drilling Technique and its Scope in Design and Prediction of Rock Blasting, International Journal of Mining Science and Technology ,2016.

Third Party Observations, PCT/US2019/015604, dated May 28, 2020.

* cited by examiner

400

SYSTEMS FOR AUTOMATED LOADING OF BLASTHOLES AND METHODS RELATED THERETO

RELATED APPLICATIONS

This application claims priority to U.S. Provisional Application No. 62/623,094 filed Jan. 29, 2018, and titled "Systems for Automated Loading of Blastholes and Methods Related Thereto," and U.S. Provisional Application No. 62/782,917 filed Dec. 20, 2018, and titled "Systems for Automated Loading of Blastholes in a Blast Pattern and Methods Relating Thereto," which are both hereby incorporated by reference in their entireties.

TECHNICAL FIELD

The present disclosure relates generally to explosives. More specifically, the present disclosure relates to systems for delivering explosives and methods related thereto. In some embodiments, the methods relate to automated loading of blastholes and methods related thereto.

BRIEF DESCRIPTION OF THE DRAWINGS

The embodiments disclosed herein will become more fully apparent from the following description and appended claims, taken in conjunction with the accompanying drawings. The drawings depict primarily generalized embodiments, which embodiments will be described with additional specificity and detail in connection with the drawings in which:

DETAILED DESCRIPTION

Figure 1:
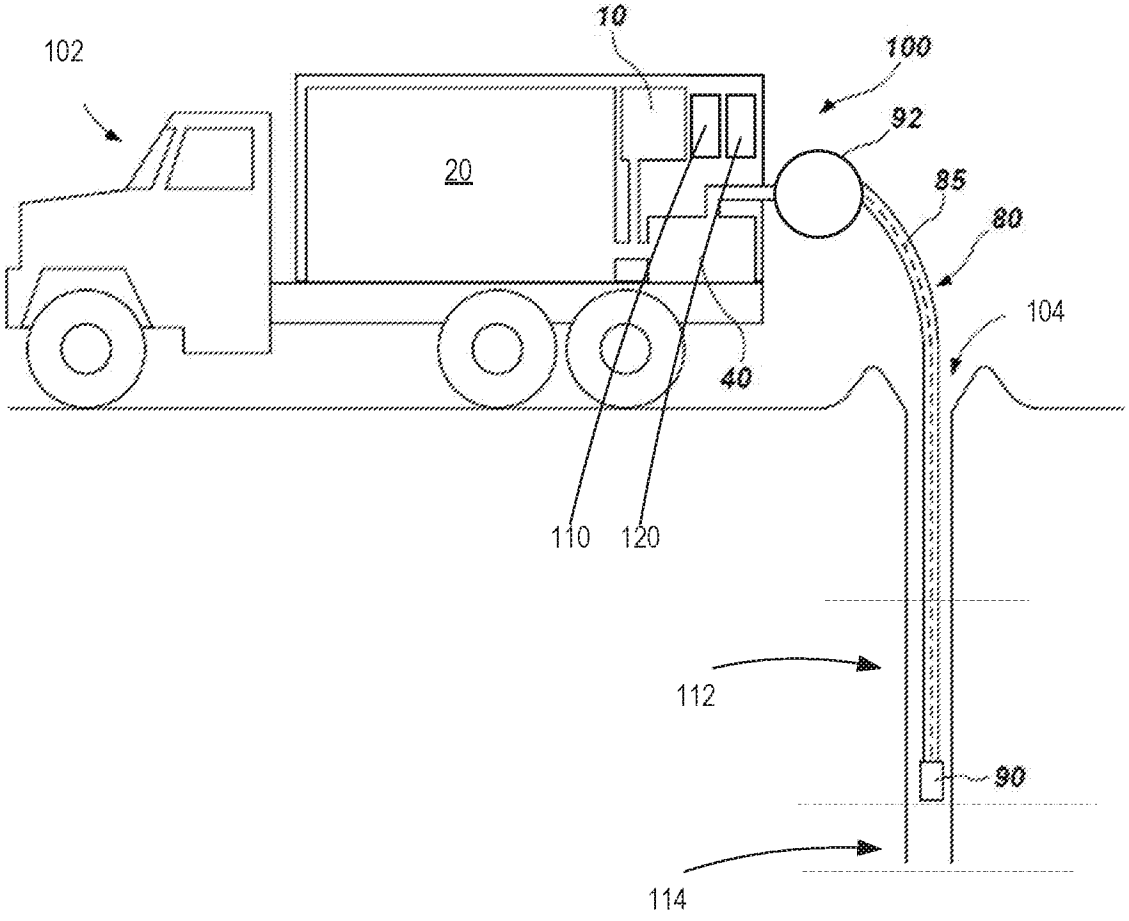
FIG. 1 illustrates a side view of one embodiment of a truck equipped with a system for automatically adjusting the density of an emulsion explosive for various segments in a blasthole.

Explosives are commonly used in the mining, quarrying, and excavation industries for breaking rocks and ore. Generally, a hole, referred to as a "blasthole," is drilled in a surface, such as the ground. Explosives may then be pumped (e.g., emulsion explosives and emulsion blends) or augered (e.g., ammonium nitrate and fuel oil (ANFO) and heavy ANFO) into the blasthole. Emulsion explosives, for example, are generally transported to a job site as an emulsion matrix that is too dense to completely detonate. In general, the emulsion needs to be "sensitized" in order for the emulsion to detonate successfully. Sensitizing is often accomplished by introducing small voids into the emulsion. These voids act as hot spots for propagating detonation. These voids may be introduced by a density reducing agent, such as by blowing a gas into the emulsion and thereby forming gas bubbles, adding microspheres or other porous media, and/or injecting chemical gassing agents to react in the emulsion and thereby form gas.

For blastholes, depending upon the length or depth, detonators may be placed at the end, also referred to as the "toe," of the blasthole and at the beginning of the emulsion explosives. Often, in such situations, the top of the blasthole will not be filled with explosives, but will be filled with an inert material, referred to as "stemming," to try to keep the force of an explosion within the material surrounding the blasthole, rather than allowing explosive gases and energy to escape out of the top of the blasthole.

Systems, methods, and apparatuses for automated loading of blastholes and methods related thereto are disclosed herein. In some embodiments, the systems, methods, and apparatuses may determine target explosive properties (e.g., explosive energy) for each blasthole in a blast pattern by identifying change points in geological properties across a blasthole and/or a blast site. For example, in some embodiments, a system may identify segments within a blasthole with similar geological properties. In some embodiments, a system may identify sections or groups of blastholes with similar geological properties by identifying change points across a distance of the blast pattern, and control a flow rate of an energy-modulating agent to a mixer to deliver an explosive with a target explosive energy value to the blasthole.

It will be readily understood that the components of the embodiments as generally described below and illustrated in the Figures herein could be arranged and designed in a wide variety of different configurations. For instance, the steps of a method do not necessarily need to be executed in any specific order, or even sequentially, nor do the steps need to be executed only once. Thus, the following more detailed description of various embodiments, as described below and represented in the Figures, is not intended to limit the scope of the disclosure, but is merely representative of various embodiments. While the various aspects of the embodiments are presented in drawings, the drawings are not necessarily drawn to scale unless specifically indicated.

The phrases "operably connected to" and "connected to" refer to any form of interaction between two or more entities, including mechanical, electrical, magnetic, electromagnetic, fluidic, and thermal interaction. Two entities may interact with each other even though they are not in direct contact with each other. For example, two entities may interact with each other indirectly through an intermediate entity.

The term "proximal" is used herein to refer to "near" or "at" the object disclosed. For example, "proximal the outlet of the delivery conduit" refers to near or at the outlet of the delivery conduit.

The phrase "change point" refers to a statistically significant change point in the data. Thus, change points within a geologic profile, such as a hardness profile are statistically significant changes in the geologic values in the geologic profile.

Embodiments and implementations of the explosive delivery systems and methods described herein may include various steps, which may be embodied in machine-executable instructions to be executed by a computer system. A computer system may include one or more general-purpose or special-purpose computers (or other electronic devices). The computer system may include hardware components that include specific logic for performing the steps or may include a combination of hardware, software, and/or firmware.

Embodiments may be provided as a computer program product including a computer-readable medium having stored thereon instructions that may be used to program a computer system or other electronic device to perform the processes described herein. The computer-readable medium may include, but is not limited to: hard drives, floppy diskettes, optical disks, CD-ROMs, DVD-ROMs, ROMs, RAMs, EPROMs, EEPROMs, magnetic or optical cards, solid-state memory devices, or other types of media/computer-readable media suitable for storing electronic instructions.

Computer systems and the computers in a computer system may be connected via a network. Suitable networks for configuration and/or use as described herein include one or more local area networks, wide area networks, metropolitan area networks, and/or Internet or IP networks, such as the World Wide Web, a private Internet, a secure Internet, a value-added network, a virtual private network, an extranet, an intranet, or even stand-alone machines which communicate with other machines by physical transport of media. In particular, a suitable network may be formed from parts or entireties of two or more other networks, including networks using disparate hardware and network communication technologies.

One suitable network includes a server and several clients; other suitable networks may contain other combinations of servers, clients, and/or peer-to-peer nodes, and a given computer system may function both as a client and as a server. Each network includes at least two computers or computer systems, such as the server and/or clients. A computer system may include a workstation, laptop computer, disconnectable mobile computer, server, mainframe, cluster, so-called "network computer" or "thin client," tablet, smart phone, personal digital assistant or other hand-held computing device, "smart" consumer electronics device or appliance, medical device, or a combination thereof.

Suitable networks may include communications or networking software, such as the software available from Novell®, Microsoft®, and other vendors, and may operate using TCP/IP, SPX, IPX, and other protocols over twisted pair, coaxial, or optical fiber cables; telephone lines; radio waves; satellites; microwave relays; modulated AC power lines; physical media transfer; and/or other data transmission "wires" known to those of skill in the art. The network may encompass smaller networks and/or be connectable to other networks through a gateway or similar mechanism.

Each computer system includes one or more processors and/or memory; computer systems may also include various input devices and/or output devices. The processor may include a general-purpose device, such as an Intel®, AMD®, or other "off-the-shelf" microprocessor. The processor may include a special-purpose processing device, such as an ASIC, SoC, SiP, FPGA, PAL, PLA, FPLA, PLD, or other customized or programmable device. The memory may include static RAM, dynamic RAM, flash memory, one or more flip-flops, ROM, CD-ROM, disk, tape, magnetic, optical, or other computer storage medium. The input device(s) may include a keyboard, mouse, touch screen, light pen, tablet, microphone, sensor, or other hardware with accompanying firmware and/or software. The output device(s) may include a monitor or other display, printer, speech or text synthesizer, switch, signal line, or other hardware with accompanying firmware and/or software.

The computer systems may be capable of using a floppy drive, tape drive, optical drive, magneto-optical drive, or other means to read a storage medium. A suitable storage medium includes a magnetic, optical, or other computer-readable storage device having a specific physical configuration. Suitable storage devices include floppy disks, hard disks, tape, CD-ROMs, DVDs, PROMs, RAM, flash memory, and other computer system storage devices. The physical configuration represents data and instructions which cause the computer system to operate in a specific and predefined manner as described herein.

Suitable software to assist in implementing the invention is readily provided by those of skill in the pertinent art(s) using the teachings presented here and programming languages and tools, such as Java, Pascal, C++, C, PHP, .Net, database languages, APIs, SDKs, assembly, firmware, microcode, and/or other languages and tools. Suitable signal formats may be embodied in analog or digital form, with or without error detection and/or correction bits, packet headers, network addresses in a specific format, and/or other supporting data readily provided by those of skill in the pertinent art(s).

Aspects of certain embodiments may be implemented as software modules or components. As used herein, a software module or component may include any type of computer instruction or computer executable code located within or on a computer-readable storage medium. A software module may, for instance, comprise one or more physical or logical blocks of computer instructions, which may be organized as a routine, program, object, component, data structure, etc., that performs one or more tasks or implement particular abstract data types. A particular software module may comprise disparate instructions stored in different locations of a computer-readable storage medium, which together implement the described functionality of the module. Indeed, a module may comprise a single instruction or many instructions, and may be distributed over several different code segments, among different programs, and across several computer-readable storage media.

Some embodiments may be practiced in a distributed computing environment where tasks are performed by a remote processing device linked through a communications network. In a distributed computing environment, software modules may be located in local and/or remote computer-readable storage media. In addition, data being tied or rendered together in a database record may be resident in the same computer-readable storage medium, or across several computer-readable storage media, and may be linked together in fields of a record in a database across a network. According to one embodiment, a database management system (DBMS) allows users to interact with one or more databases and provides access to the data contained in the databases.

In some embodiments of an explosives delivery system, the system comprises a first reservoir configured to store an energy-modulating agent, such as a density-reducing agent. The system may also comprise a second reservoir configured to store an energetic substance, such as an emulsion matrix, and a mixer configured to combine the energetic substance and the energy-modulating agent into an explosive, such as an emulsion explosive. The mixer may be operably connected to the first reservoir and the second reservoir. A delivery device, such as a delivery conduit, may be operably connected to the mixer, the first reservoir, and the second reservoir, and configured to convey the explosive into a blasthole.

In some embodiments, the explosives delivery system may comprise processor circuitry to receive dimensions of the blasthole. The processor circuitry may determine change points within a geologic profile, where the geologic profile may include hardness values representing geological characteristics, such as hardness, along the length of the blasthole. The processor circuitry may segment the blasthole into groups separated by the change points. Additionally, the processor circuitry may determine a representative hardness value for each group. Additionally, the processor circuitry may determine a target explosive energy value for each group based on the representative hardness value, thereby generating a target explosive energy profile comprising target explosive energy values along the length of the blasthole. The system may control a flow rate of the energy-modulating agent, such as a density-reducing agent, to the mixer to vary the energy of the explosive as needed according to the target explosive energy profile.

In some embodiments of methods of delivering explosives, the methods comprise receiving dimensions of the blasthole. The methods further comprise determining any change points within a geologic profile, wherein the geologic profile comprises geologic data such as hardness values representing geologic hardness characteristics along a length of the blasthole. The methods may further comprise segmenting the blasthole into one or more groups separated by the change points. The methods may further comprise determining a representative hardness value for each group. The methods may further comprise determining a target explosive energy value, such as a target emulsion density value, for each group of the one or more groups based on the representative hardness value. The methods may further comprise mixing an energetic substance (e.g., an emulsion matrix) and the energy-modulating agent (e.g., a density-reducing agent) into an explosive. The method may further comprise controlling a flow rate of the energy-modulating agent to achieve the target explosive energy for each group.

Methods of determining an emulsion explosive density profile for a blasthole are also disclosed herein. In some embodiments, the methods comprise determining any change points within a geologic profile, wherein the geologic profile comprises geologic data such as hardness values representing hardness characteristics along a length of the blasthole. The methods may further comprise segmenting the blasthole into one or more groups separated by any identified change points. The methods may further comprise determining a representative hardness value within each group. The methods may further comprise determining a target emulsion density for each group based on the representative hardness value for each group, thereby generating a target density profile comprising target emulsion density values along the length of the blasthole.

Non-transitory computer-readable media are also disclosed herein. In some embodiments, the media comprise instructions to cause, upon execution of the instructions by one or more processors, an explosive delivery system to receive dimensions of a blasthole and determine any change points within a geologic profile, wherein the geologic profile comprises geologic data such as hardness values representing hardness characteristics along a length of the blasthole. The media may further comprise instructions to segment the blasthole into one or more groups separated by any identified change points. The media may further comprise instructions to identify a representative hardness value within each group. The media may further comprise instructions to determine a target explosive energy or a target emulsion density for each group based on the representative hardness value, thereby generating either a target explosive energy profile or a target emulsion density profile comprising target values along the length of the blasthole.

Much of the disclosure herein is specific to emulsion explosives where the emulsion matrix is the energetic substance and the density-reducing agent is the energy-modulating agent. The disclosure herein regarding emulsion explosives is applicable to other explosives. Likewise, the disclosure herein regarding explosives generally is applicable to emulsion explosives. Emulsion explosives are one example of an explosive contemplated by this disclosure. Other examples of explosives are ANFO, heavy ANFO, and ANFO or ammonium nitrate (AN) prill blends with emulsion explosives. The systems and methods disclosed herein are applicable to a variety of explosives. For example, the energetic substance may be ANFO and an energy-modulating agent may be mixed with the ANFO in varying amounts as the ANFO is augered into the blasthole, to thereby increase or decrease the energy level of the ANFO at particular depths of the blasthole according to a target explosive energy profile. In another example, ANFO or AN prill may be the energy-modulating agent and an emulsion explosive may be the energetic substance. In this example, the emulsion explosive may be at a constant or variable density. The ANFO or AN prill may be mixed with the emulsion explosive in varying amounts as it is augered or pumped into the blasthole, to thereby increase or decrease the energy level of the explosive blend at particular depths of the blasthole according to a target explosive energy profile. One of ordinary skill in the art, with the benefit of this disclosure, would understand that a variety of energetic substances and energy-modulating agents may be used with the systems and methods disclosed herein.

Turning now to the figures, FIG. 1 illustrates a side view of one embodiment of a truck 102 equipped with an explosive delivery system 100 for automatically adjusting the density of an emulsion explosive for various segments in a blasthole or various blasthole groups within a blast pattern. As shown, the explosive delivery system 100 may include a first reservoir 10, a second reservoir 20, and a mixer 40 mounted on the truck 102.

An emulsion explosive may be formed by mixing the contents of the first reservoir 10 and the second reservoir 20. The first reservoir 10 may store a density-reducing agent. The second reservoir 20 stores an emulsion matrix. The mixer 40 is operably connected to the first reservoir 10 and the second reservoir 20. The mixer 40 combines the density-reducing agent and the emulsion matrix into an emulsion explosive. In some embodiments, the density-reducing agent comprises a chemical gassing agent.

The mixer 40 may combine the density-reducing agent and the emulsion matrix at one or more places. In some embodiments, the mixer 40 may combine the density-reducing agent and the emulsion matrix on the truck 102, in a delivery conduit 80, and/or in a blasthole 104. In some embodiments, the delivery conduit 80 is indirectly connected to the first reservoir 10 and second reservoir 20. For example, as shown, the mixer 40 may connect the delivery conduit 80, the first reservoir 10 and the second reservoir 20. In this arrangement, the mixer 40 may produce an emulsion explosive 85 on the truck 102. In some embodiments, the delivery conduit 80 is configured to introduce the density-reducing agent to the emulsion matrix proximal an inlet of the mixer when the mixer is located in the nozzle 90.

In some embodiments, the mixer 40 may produce the emulsion explosive 85 within the blasthole 104. For example, the mixer may be located in a nozzle 90 proximal an outlet of the delivery conduit 80 and the mixer 40 may not be present. In such embodiments, the delivery conduit 80 may include one tube for conveying emulsion matrix and a separate tube for conveying the density-reducing agent to the nozzle 90 to be combined with the emulsion matrix. In embodiments where the nozzle 90 is used to mix the density-reducing agent and the emulsion matrix, the density of the emulsion explosive 85 being conveyed into the blasthole 104 can be rapidly changed with precision.

The nozzle 90 is connected at the end of the delivery conduit 80. The delivery conduit 80 is operably connected to the mixer 40. The delivery conduit 80 and the nozzle 90 are configured to convey the emulsion explosive 85 into the blasthole 104. The truck 102 is positioned near the vertical blasthole 104. The delivery conduit 80 is unwound from a hose reel 92 and inserted into the vertical blasthole 104.

In some embodiments, the explosive delivery system 100 comprises processor circuitry 110 to determine segments 112, 114 within the blasthole 104 with different geologic hardness characteristics. The processor circuitry 110 may also control a flow rate of the density-reducing agent in the first reservoir 10 to achieve a target emulsion density based on the geologic hardness characteristics for each segment. Accordingly, the explosive delivery system 100 may automatically adjust the density of an emulsion explosive for the segments 112, 114 in the blasthole 104. By differentiating the segments 112, 114 and adjusting the density of the emulsion explosive 85 within each segment 112, 114, blasting can be tailored to the geologic properties of the particular blasthole and dig rates and mill productivity can be increased thereby.

In some embodiments, the processor circuitry 110 may determine that a first emulsion explosive group at a first density has been delivered to the blasthole 104 and that a second emulsion explosive group at a second density is to be delivered to the blasthole 104. For example, the processor circuitry 110 may determine that a sufficient volume of explosive to fill a particular length or depth of the blasthole 104 has been achieved. The processor circuitry 110 may then modify the flow rate of the density-reducing agent such that the emulsion explosive 85 delivered by the delivery conduit 80 has the target emulsion density associated with the second emulsion explosive group.

For example, the processor circuitry 110 may monitor a delivery rate of the emulsion matrix to determine, based on the dimensions of the blasthole 104 and the expansion of the emulsion matrix due to gassing (i.e., formation of the emulsion explosive), a current group of the blasthole 104 being filled. In some embodiments, the depth of the delivery conduit 80 may be based on the amount of delivery conduit 80 on the hose reel 92.

When the processor circuitry 110 determines that a second emulsion explosive group at a second density is to be delivered to the blasthole 104, the processor circuitry 110 may modify the flow rate of the density-reducing agent such that the emulsion explosive 85 delivered by the delivery conduit 80 has the target emulsion density associated with the second emulsion explosive group. For instance, the processor circuitry 110 may send a signal to the mixer 40 to increase the amount of the density-reducing agent or to reduce the density of the emulsion explosive 85.

In some embodiments, the explosive delivery system 100 may comprise a memory storage device 120. The memory storage device 120 may store a table comprising target emulsion densities for a plurality of hardness values. In some embodiments, to determine the target emulsion density for each group, the processor circuitry 110 accesses the table and locates a target emulsion density based on the representative hardness value identified for each group.

The processor circuitry 110 may receive more detailed information about each of the blastholes including the geologic profile. In some embodiments, the processor circuitry 110 generates a geologic profile based on one or more types of geologic data. Non-limiting examples of geologic data include mineralogy (elemental and/or mineral), lithologic structure (primary, secondary, and/or texture), porosity, hardness, rock strength, and density. "Texture" refers to the size, shape, and arrangement of the interlocking mineral crystals which form a rock or other material. The geologic data may be used to determine further geologic characteristics, such as friability and fragmentability. The geologic data may be determined directly or indirectly from sources such as seismic data, drilling data, drill cuttings, core samples, or combinations thereof. For example, drill cuttings and/or core samples may be analyzed using x-ray or gamma-ray fluorescence, scanning electron microscopy, and other spectroscopy and/or microscopy techniques. The geologic data may include information on an incremental basis, such as on a per foot basis.

In the case of drilling data, the processor circuitry 110 may receive drilling data, a diameter of the blasthole 104, and the length of the blasthole 104. The drilling data may include information on an incremental basis, such as, on a per foot basis. The drilling data may include information such as drill bit size, drill bit rotary speed, drill bit torque, penetration rate, bit vibration, pull down pressure, bailing air pressure, hole location, hole number, and hole length or depth. The drilling data may correlate to the geologic properties along the length of the blasthole. Thus, drilling data can be used to generate hardness values along the length of the blasthole (i.e., the hardness profile). For example, the processor circuitry 110 may receive the drill data and generate the hardness profile or may receive the hardness profile from another system that generated the hardness profile from the drilling data. The processor circuitry 110 may receive drilling data directly from one or more drill rigs or from a separate source that has received the drilling data. The processor circuitry may also receive the hardness profile and dimensions of the blasthole, instead of receiving the drilling data.

In the case of seismic data, the processor circuitry 110 may receive data from one or more geophones or other seismic sensors. The geophones may record vibration during drilling and/or from test charges. The processor circuitry 110 may compare seismic vibration at a source (e.g., the drill or test charge) and seismic vibrations at the one or more geophones. Based at least on the delay, frequency, and amplitude of the seismic vibrations, the processor circuitry 110 may determine geologic properties (e.g., fragmentation, composite densities, compositions, rock impedances, hardness value, Young's modulus, shear strain, or other such properties).

In some embodiments, the processor circuitry 110 may determine an energy profile comprising a target explosive energy for one or more groups of blastholes, and a processor on the truck 102 to deliver the explosive according to the energy profile.

In some embodiments, the processor circuitry 110 receives a blast pattern comprising location data of a plurality of blastholes, and geologic values associated with the plurality of blastholes. The geologic values represent geologic characteristics of the plurality of blastholes. In some embodiments, the geologic values comprise an average geologic value for each of the plurality of blastholes. For example, when the geologic values include hardness values, then the hardness value may be an average hardness value for each of the plurality of blastholes.

The processing circuitry 110 may determine any change points in the geologic values along a distance of the blast pattern. The distance of the blast pattern where the processor circuitry is to determine any change points in the geologic values may be a row or a line of holes in a burden direction. In some embodiments, change points may be determined in both spacing and burden directions of a blast pattern. In some embodiments, change points may be determined row by row. In some embodiments, an anchor blasthole may be used as a starting location, and change points are determined across a line in the blast plan at a plurality of angles.

In some embodiments, the processing circuitry 110 can determine segment changes by using a lookup table where material type, average hardness and hole diameter (as an example) could be used to provide a loading profile for each hole. The loading profiles could be applied on a hole by hole basis.

The processing circuitry 110 may segment the blast pattern into one or more groups of blastholes separated by any identified change points. Additionally, the processing circuitry 110 may determine a target explosive energy for each group of blastholes based on a representative geologic value for each group of blastholes, thereby generating a target energy profile comprising target explosive energy values for each blasthole in the plurality of blastholes. In some embodiments, an available amount of explosive material is used to determine the target explosive energy for each group. The processing circuitry 110 may control a flow rate of the energy-modulating agent to the mixer to deliver, via the delivery device, the explosive with a target explosive energy value to the blasthole 104 according to the target energy profile.

Alternatively, the processor circuitry 110 can determine segment changes based on other methods. For example, when three segments are desired, the blastholes can be separated numerically into a low hardness category, a medium hardness category, and a high hardness category. In that example, blastholes in the first segment, the low hardness category, might be filled with ANFO and a bulking agent, to reduce the energy of the ANFO. The blastholes in the second segment, the medium hardness category, might be filled with ANFO. The blastholes in the third segment, the high hardness category, might be filled with heavy ANFO.

Figure 2A:
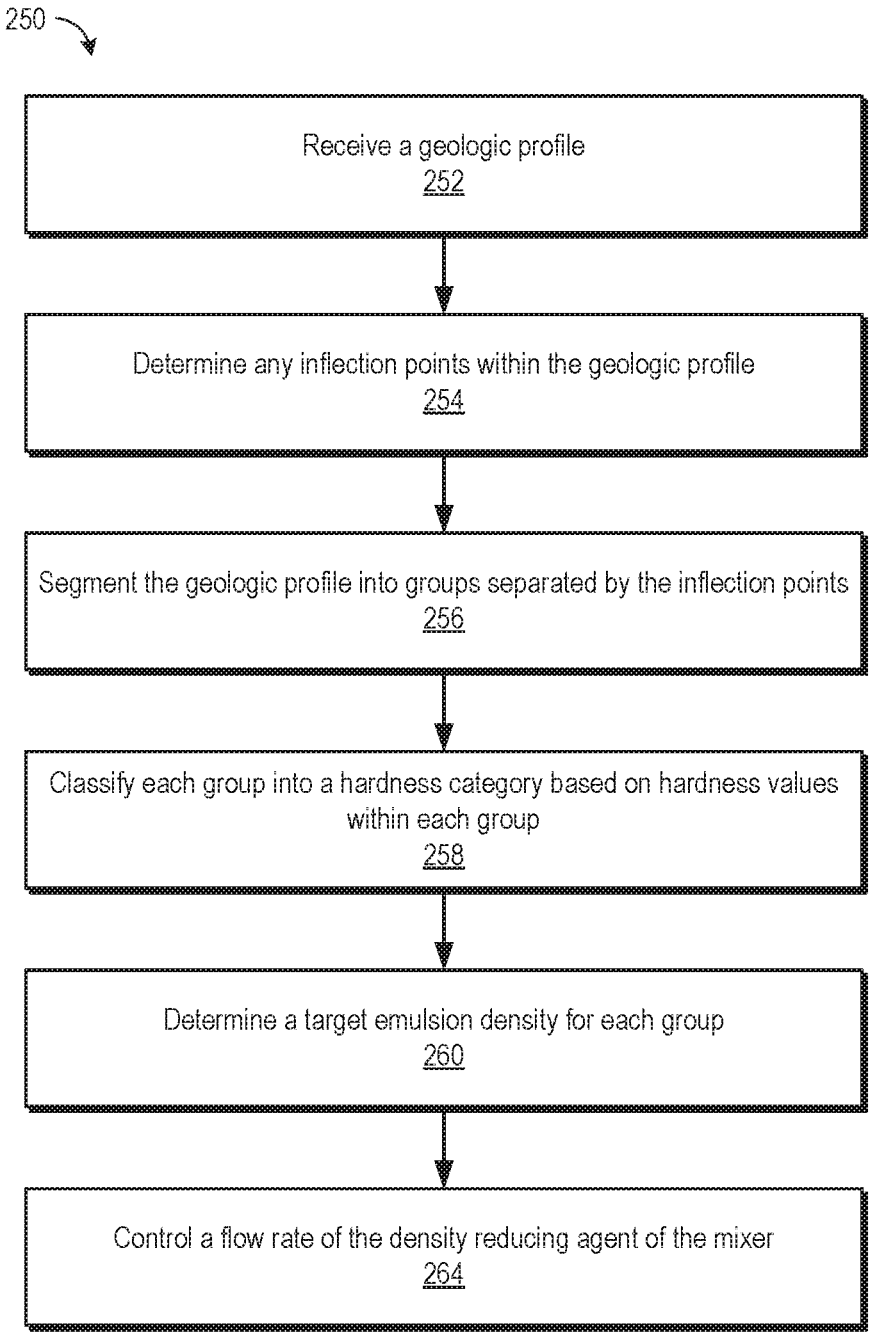
FIG. 2A illustrates a flow chart of one embodiment of a method of delivering explosives.

FIG. 2A illustrates a flow chart of one embodiment of a method 250 of delivering explosives. The method 250 described with reference to FIG. 2A may be executed by processor circuitry, such as the processor circuitry 110 of FIG. 1.

In this embodiment, the method 250 comprises receiving 252 a geologic profile. The geologic profile may include geologic values representing one or more geologic characteristics of the plurality of blastholes in the blast plan. In some embodiments, the method includes receiving drilling data comprising geologic hardness characteristics, a diameter of the blasthole, and a length of the blasthole. This information may be provided directly by data received during a drilling operation, or may be operator entered. In some embodiments, the method includes receiving seismic data. In some embodiments, the method 250 includes generating a hardness profile based on drilling data and/or seismic data.

The method 250 further includes determining 254 any change points also sometimes referred to as inflection points within the geologic profile. In some embodiments, the method determines 254 change points across the coordinates of the plurality of blastholes in the blast plan (e.g., FIGS. 13 and 14). In some embodiments, the method determines 254 change points within a blasthole (e.g., FIG. 2B).

Figure 3:
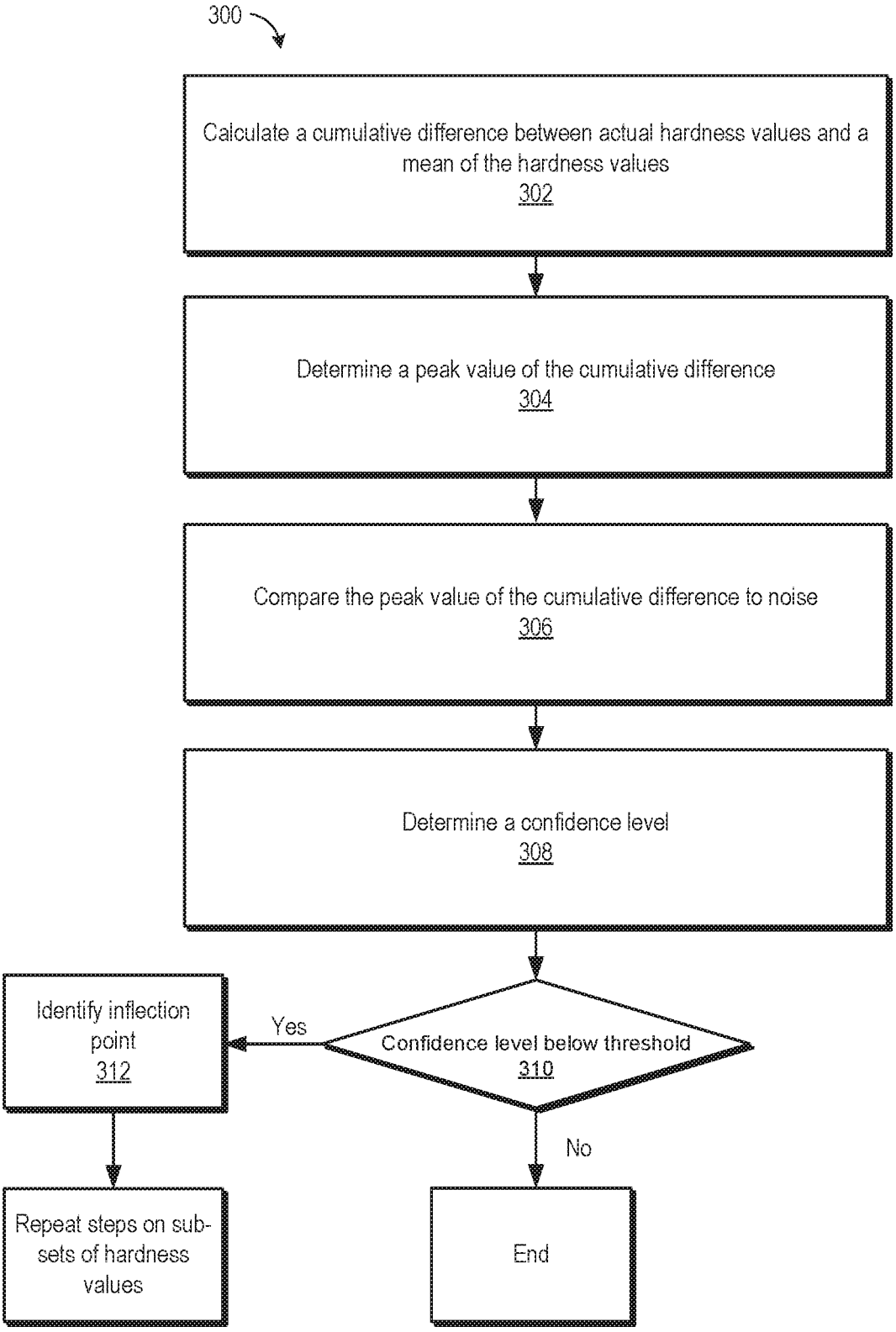
FIG. 3 illustrates a flow chart of one embodiment of a method of determining change points of a hardness profile of a blasthole.

See FIG. 3 for an illustration of how one embodiment finds change points within the geologic profile. In some geologic profiles there are no change points. This results in a single target emulsion density to be used for an entire blast plan. In other geologic profiles there are one or more change points, such as multiple change points resulting in multiple groups with one or more different target emulsion densities. For example, the change points may be determined using a sequential analysis technique, such as a cumulative sum technique, or other techniques that determine the confidence level of a change in momentum in a data series.

In some embodiments, the emulsion density may be varied within a blasthole. For example, a user may preselect a desired profile for blast holes in a blast pattern. The profile may be unique to each blasthole, may apply to all blast holes, or a group of blastholes. Thus the energy distribution within each hole may vary based on the preselected profile.

It should be understood that the disclosed methods of varying the explosive energy of explosives in a blasthole may be used to implement any number of desired explosive energy profiles of the sensitized product. For example, it may be desirable to have a lower density explosive at a top of a blasthole and a higher density explosive at a bottom of a blasthole. For example, the energy distribution of a blasthole may be roughly pyramidal. In another example, the energy profile may have a higher density explosive at the top of the blasthole. The resulting energy distribution of the blasthole may be an inverted pyramid. In yet another example, the explosive near a middle section of the blasthole may have a higher density than the top or the bottom, resulting in a convex shaped energy distribution.

The method 250 further includes segmenting 256 the geologic profile into one or more groups separated by any identified change points. The groups may be vertical segments within a blasthole and/or groups of blastholes across the coordinates of a blast plan. The method 250 further includes determining 258 a representative geologic value for each group. The representative geologic value may be defined by a probability distribution, an average geologic value, a maximum geologic value, or a minimum geologic value for a particular group. Examples of a probability distribution include the mean, median, or mode of the geologic values for a particular group.

The method 250 further includes determining 260 a target explosive energy value, such as a target emulsion density, for each group based on the representative geologic value for each group, thereby generating a target explosive energy profile comprising target explosive energy values for each segment. In some embodiments, determining the target explosive energy value for each group comprises accessing a table and locating the target explosive energy value based on the representative geologic value associated with each group. The table can include target explosive energy values for a plurality of geologic values.

The target explosive energy values may be found from an algorithm, based on previous experience, or a combination thereof. For example, in embodiments where an algorithm is used to generate the hardness profile from drilling data and/or seismic data, the hardness values generated may be relative values, not absolute values. When relative values are generated, then it may be beneficial to conduct one or more test charges in the blast site and compare the performance of different target explosive energy values at particular hardness values within the test blastholes. For example, in such a manner, the target emulsion densities correlated with particular hardness values can be fine-tuned. Or stated another way, the output of the algorithm used to generate the hardness profile can be fine-tuned with one or more test blasts. Thus, the target emulsion densities generate a target density profile comprising target emulsion density values along the length of the blasthole. The target energy profile, such as a target density profile, may be modified with a stemming length, an air decking location and length, other regions devoid of emulsion explosive, or combinations thereof.

Test blasts and/or previous blasts may be used to fine-tune the target energy profile to obtain a desired fragmentation size. Feedback from the test blasts and/or previous blasts may include fragmentation size data from a mill analysis, a muck pile analysis, or a conveyor analysis. The method 250 may include changing emulsion densities associated with hardness values to optimize future blasts based on the feedback. For example, the future blast may have an optimized fragmentation size based on the feedback. Optimizing future fragmentation size may include adjusting the target energy profile to alter the fragmentation size so that the fragments are closer to a target or desired size. For example, a system may alter the values of a lookup table that the system uses to determine target explosive values. For instance, if the table includes target explosive energy values for a plurality of geologic values, the system may use the feedback to alter the target explosive energy values, the plurality of geologic values, or both. For example, the outputs of the algorithm used to generate the geologic values and/or the geologic profile can be fine-tuned so as to achieve a desired fragmentation size. In some embodiments, the method 250 may alter the geologic values for a group based on the feedback. In some embodiments, the method 250 may alter the segmentation based on the feedback. In some embodiments, the method 250 may alter one or more of the lookup table, the geologic values for a group, and the segmentation based on the feedback.

The method 250 may further include controlling 264 a flow rate of the energy-modulating agent to the mixer to achieve the target explosive energy value for the blasthole being filled.

The method 250 may further include the operator confirming or inputting the depth of any water present in the blasthole. The target emulsion density for explosives in contact with water may be automatically increased to greater than 1 g/cm$^2$, if the target emulsion density for the group was not already greater than 1 g/cm$^2$.

In some embodiments, only a portion of the steps of the method 250 may be performed. For example, when the geologic profile is generated, rather than received, then step 252 may not be performed. In yet another example, in some embodiments only steps 254-260 may be performed. Additionally, in some embodiments, some of the steps of the method 250 may be combined together into a single step.

Figure 2B:
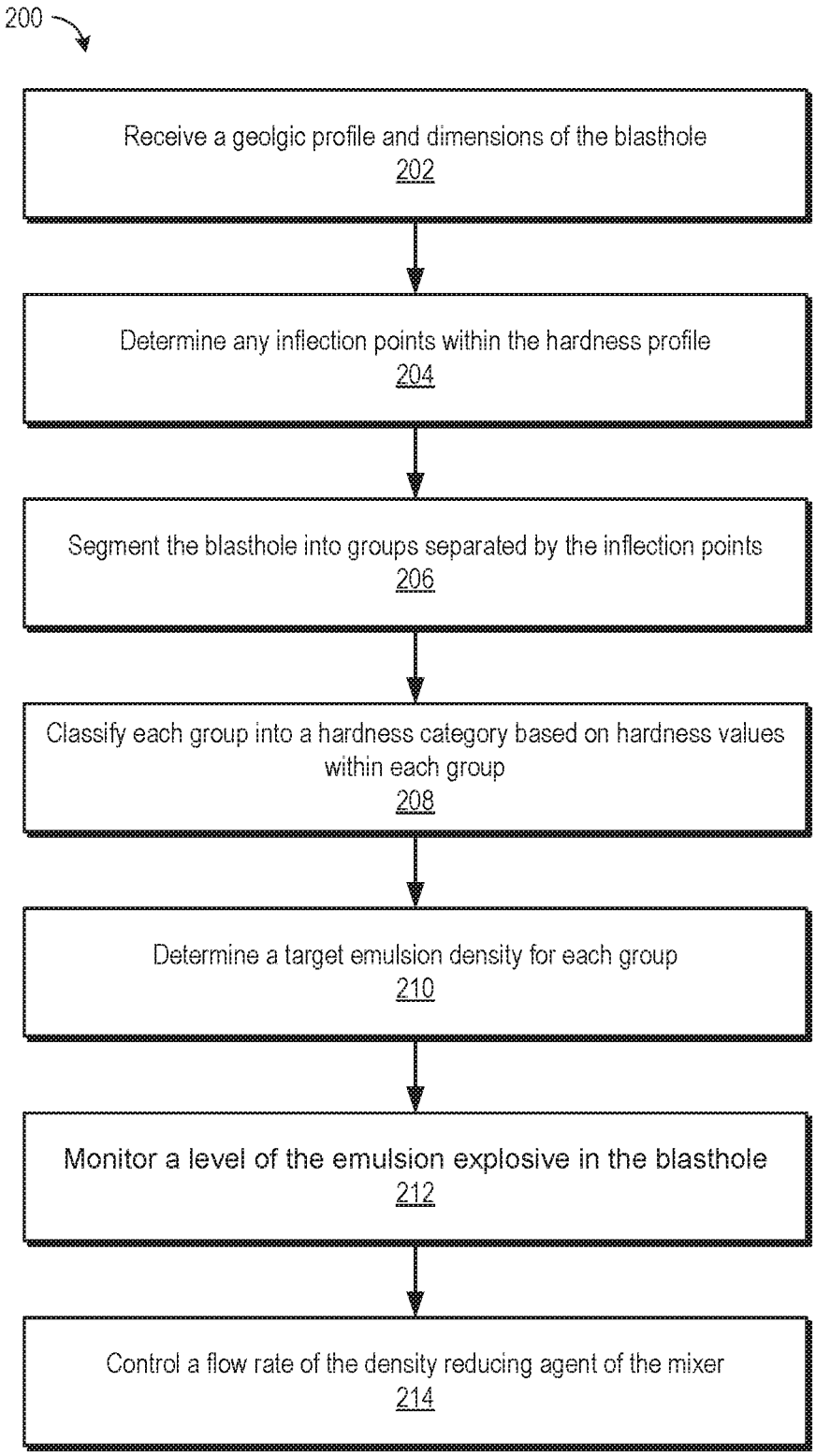
FIG. 2B illustrates a flow chart of one embodiment of a method of delivering explosives based on geological characteristics of a blasthole with varying target explosive energy within a blasthole.

FIG. 2B illustrates a flow chart of one embodiment of a method 200 of delivering explosives with varying target explosive energy within a blasthole. The method 200 may segment a blasthole and determine a target emulsion density for each section of the blasthole. The method 200 described with reference to FIG. 2B may be executed by processor circuitry, such as the processor circuitry 110 of FIG. 1.

In this embodiment, the method 200 comprises receiving 202 a geologic profile and dimensions of the blasthole. The geologic profile may include hardness values or other geologic values representing one or more geologic characteristics along the depth of the blasthole. In some embodiments, the method includes receiving drilling data comprising geologic hardness characteristics, a diameter of the blasthole, and a length of the blasthole. This information may be provided directly by data received during a drilling operation, or may be operator entered. In some embodiments, the method 200 includes receiving seismic data. In some embodiments, the method 200 includes generating a hardness profile based on drilling data and/or seismic data.

The method 200 further includes determining 204 any change points also sometimes referred to as inflection points within the geologic profile. See FIG. 3 for an illustration of how one embodiment finds change points within the geologic profile. In some geologic profiles there are no change points. This results in a single target emulsion density to be used for an entire blasthole. In other geologic profiles there are one or more change points, such as multiple change points resulting in multiple groups with one or more different target emulsion densities. For example, the change points may be determined using a sequential analysis technique, such as a cumulative sum technique, or other techniques that determine the confidence level of a change in momentum in a data series.

The method 200 further includes segmenting 206 the blasthole into groups separated by the change points. The number of segments may be limited by physical parameters of the blasthole and/or explosive delivery system. For example, a maximum number of supported segments may be based on parameters of the blasthole, flow rate of delivery system equipment and/or limitations or responsiveness of the control system for the delivery system equipment. In some embodiments, the control system for the delivery system equipment may only allow a certain number of density changes, such as, for example, four, six, or eight density changes (which equates to four, six, or eight segments in the blasthole). The parameters of the blasthole may include a stemming depth, a blasthole length, and a blasthole diameter. The method 200 may include determining a maximum number of density changes achievable by the delivery system equipment, the control system, or both. The method 200 may include removing segments or potions of segments to be occupied by stemming, air decking, other regions devoid of emulsion explosive, or combinations thereof. For example, an operator may be able to input into a user interface the stemming length and any air decking location and length, and the processor circuitry can modify the segments accordingly. The processor circuitry may also receive that information in other ways.

The method 200 further includes determining 208 a representative geologic value for each group. The representative geologic value may be defined by a probability distribution, a maximum geologic value, or a minimum geologic value for a particular group. Examples of a probability distribution include the mean, median, or mode of the geologic values for a particular group.

The method 200 further includes determining 210 a target explosive energy value, such as a target emulsion density, for each group based on the representative geologic value for each group. In some embodiments, determining the target explosive energy value for each group comprises accessing a table and locating the target explosive energy value based on the representative geologic value associated with each group. The table can include target explosive energy values for a plurality of geologic values. The target explosive energy values may be found from an algorithm, based on previous experience, or a combination thereof. For example, in embodiments where an algorithm is used to generate the geologic profile from drilling data and/or seismic data, the geologic values generated may be relative values, not absolute values. When relative values are generated, then it may be beneficial to conduct one or more test charges in the blast site and compare the performance of different target explosive energy values at particular geologic values within the test blastholes. For example, in such a manner, the target emulsion densities correlated with particular geologic values can be fine-tuned. Or stated another way, the output of the algorithm used to generate the geologic profile can be fine-tuned with one or more test blasts. Thus, the target emulsion densities generate a target density profile comprising target emulsion density values along the length of the blasthole. The target energy profile, such as a target density profile, may be modified with a stemming length, an air decking location and length, other regions devoid of emulsion explosive, or combinations thereof.

The method 200 may further include monitoring 212 a level of the explosive in the blasthole. For example, the method 200 may determine a current group based on the volume of explosive that has be delivered to the blasthole and the known geometry of the blasthole. The method 200 may determine that a current group has been filled and a new group is to be filled.

The method 200 may further include controlling 214 a flow rate of the energy-modulating agent to the mixer to achieve the target explosive energy value for the group at the level of the explosive. For example, when a change point is passed, the method 200 may adjust the explosive to the target explosive energy value associated with the new group, such as by adjusting the density of the explosive when the explosive contains an emulsion explosive.

Additionally, the operator can confirm or modify the length of the blasthole associated with the geologic profile, based on the actual length of the blasthole, as compared to the length of the blasthole as recorded during drilling. The method 200 may include modifying the length of the last group or the first group to accommodate for deviations between the blasthole length associated with the geologic profile and the actual blasthole length.

FIG. 3 illustrates a flow chart of one embodiment of a method 300 of determining change points of a geologic profile, exemplified for a hardness profile, of a blasthole. The method 300 described with reference to FIG. 3 may be executed by processor circuitry, such as the processor circuitry 110 of FIG. 1. Using a cumulative summation approach, the processing circuitry can perform an iterative analysis on a hardness profile and compare the cumulative difference for each iteration to random "noise." Based on the noise comparison, a confidence level for possible change points can be found. The process can be iteratively repeated on subsets of hardness values to identify any additional change points.

The hardness values may be included with data generated from drilling a blasthole, may be generated from drilling data, may be generated from seismic data, or may be independently received by the processor circuitry 110.

The method 300 may include calculating 302 a cumulative difference between actual hardness values and a mean of the hardness values for the blasthole. The hardness profile may include hardness values on an incremental basis, such as a per-foot basis. When the incremental basis is consistent, then each increment can be treated as a segment for cumulative sum purposes. The cumulative difference ($S_x$) may be found by summing the prior segments' cumulative difference ($S_{x-1}$) and the difference between the current segment hardness ($H_1$) and the mean hardness ($m_H$) of the set of hardness values, such that:

$$S_x = S_{x-1} + (H_x - m_h) \qquad \text{Equation 1}$$

Equation 1 may be applied sequentially to each segment. Using this specific cumulative sum approach, the first cumulative difference ($S_0$) and the last cumulative data point are always going to be zero.

The method 300 may further determine 304 a first peak value of the cumulative difference. Methods of determining peak values (which can be positive or negative) can include plotting the value of each difference. Any changes in direction in the plotted cumulative difference represent a change, or a potential change point, in the hardness profile. Other mathematical approaches may be used for determining changes in direction in the data.

Next, the change in direction may be evaluated to determine whether the change is statistically significant. Therefore, the processing circuitry may test the possible change point to see if it is just noise or there is actually a quantifiable change in mean.

The method 300 may further include comparing 306 the first peak value to statistical noise in the actual hardness values and identifying the first peak value as a change point if the first peak value exceeds statistical noise. For example, in one embodiment, the method 300 randomizes the actual hardness values to generate a plurality of randomly ordered hardness profiles. The method 300 may then calculate a cumulative difference and peak value for each of the plurality of randomly ordered hardness profiles. The method 300 may compare these random peak values to the first peak value to determine the percentage of random peak values that exceed the first peak value.

The method 300 may use the comparison between the first peak value and statistical noise to determine 308 a confidence level. The confidence level may provide insight to whether the first peak value is a change point. In the illustrated embodiment, the confidence level is compared 310 to a threshold confidence value. The method identifies 312 the first peak value as a change point if the percentage of random peak values that exceed the first peak value is less than a selected confidence value. For example, the threshold may be set to 95%, and if the percentage of random peak values that exceed the first peak value is less than 5% the point is identified as a change point. The threshold confidence value is a parameter that may be set by a user, such as via processing circuitry.

The method 300 may iterate the steps on a subset of the hardness values. The subset may include values between previously identified change points and blasthole boundaries. Thus, the method 300 may identify any additional change points by iteratively determining additional peak values of portions of the hardness values bounded by one or more previously determined change points and comparing each of the additional peak values to statistical noise in the relevant portions of the actual hardness values, and identifying each of the additional peak values as a change point if each of the additional peak values exceeds statistical noise. The iterative process may continue until peak values for that subset of data no longer yield change points or until a maximum number of segments is reached.

In some embodiments, a change point may be discarded, even though it has a sufficiently high confidence level, if the change point is too close to an already identified change point. For example, if the previously identified, but too close, change point had a higher confidence level than the later identified change point, then the later identified change point may be discarded. Likewise, if the later identified, but too close, change point had a higher confidence level than the previously identified change point, it may be discarded. The minimum distance between change points may be a user set parameter or may be determined by processing circuitry, based on factors such as responsiveness of the equipment and/or control system to changes in process control values (e.g., changes in the flow rate of a chemical gassing agent).

In some embodiments, the processing circuitry may be configured to determine all change points in a blasthole. In scenarios where more change points are identified than can be utilized, then the change points can be ranked by confidence level and the change points with the highest confidence levels utilized. For example, when a system is limited to six different segments that can be delivered to a blasthole, but more than five change points are identified, then the five change points with the highest confidence levels would be utilized.

In some situations, no change point will be identified in the blasthole. In these situations, a single target emulsion density is used for the blasthole. In other situations multiple change points will be identified. In these situations, multiple groups with different target emulsion densities will be identified.

FIGS. 4-11 illustrate the results of a specific embodiment of the method 300 of FIG. 3 applied to an example hardness profile 400. It should be understood that the method 300 may be applied to any geologic value, not just hardness values.

Processor circuitry, such as the processor circuitry 110 of FIG. 1, could receive the hardness profile 400 and identify any change points via the method 300 of FIG. 3.

Figure 4:
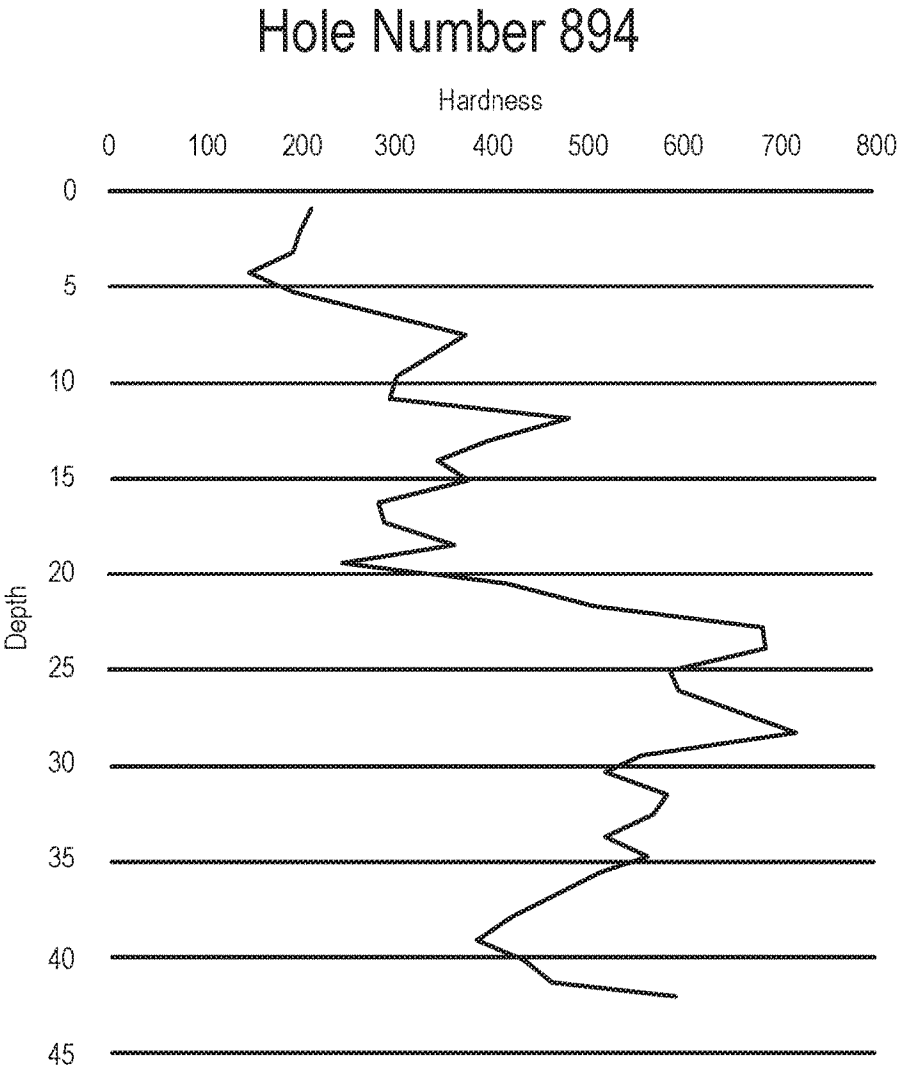
FIG. 4 illustrates an example hardness profile plotted for a blasthole.

Specifically, FIG. 4 illustrates an example hardness profile 400 plotted for a blasthole.

Figure 5B:
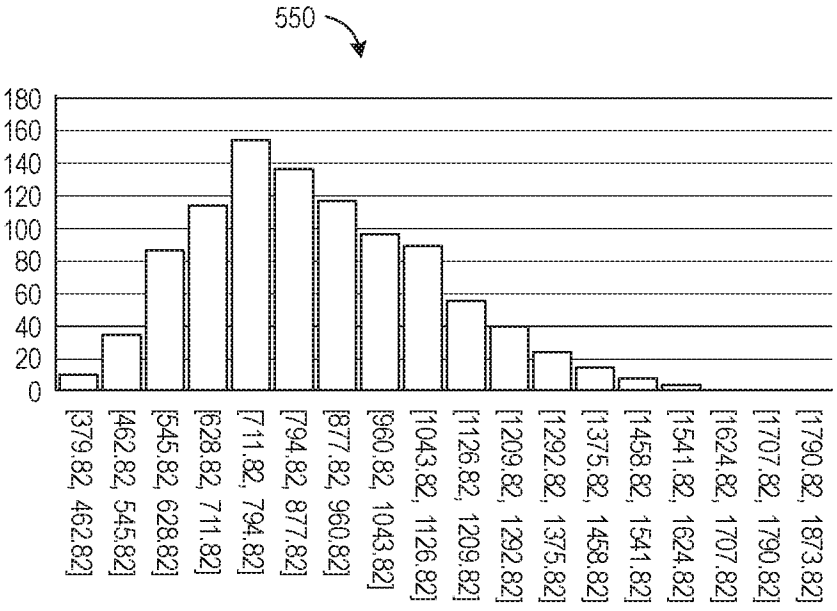
FIG. 5B depicts a graph of a distribution of the difference between the maximum and minimum values of the cumulative difference of the randomly ordered hardness profiles of FIG. 5A.
Figure 5A:
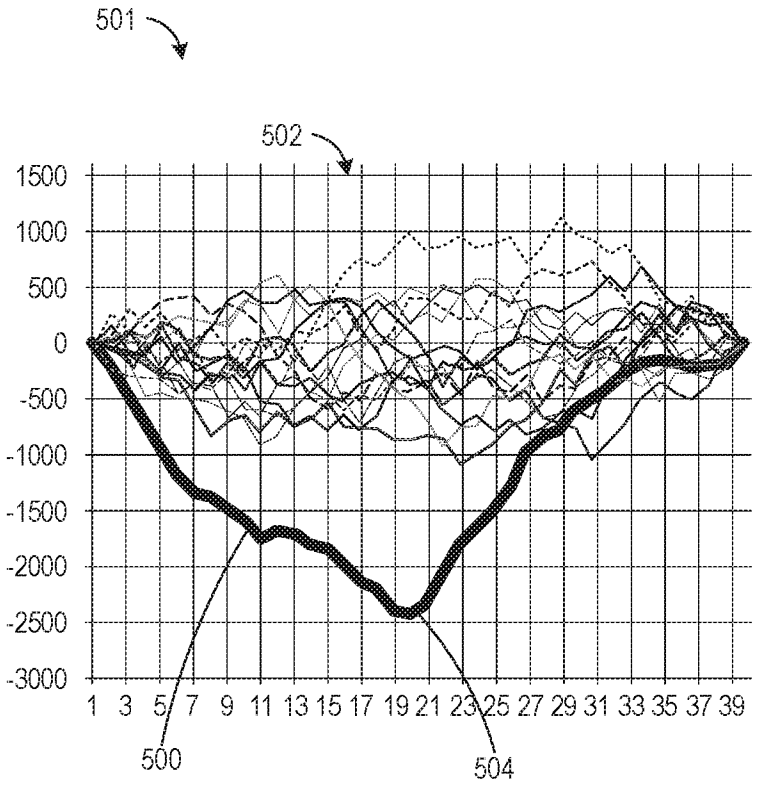
FIG. 5A illustrates an example cumulative difference calculated for the hardness profile of FIG. 4, plotted against randomly ordered hardness profiles using the same hardness values of the hardness profile of FIG. 4.

FIG. 5A illustrates a cumulative difference 500 for the hardness profile 400 plotted with random noise 502. A peak 504 of the cumulative difference 500 indicates that there was a change point at that point in the blasthole. The random noise 502 was used to provide confidence that the peak 504 represented a change point.

The cumulative difference ($S_x$) was found by summing the prior segments cumulative difference ($S_{x-1}$) and the difference between the current segment hardness ($H_1$) and the mean hardness ($m_H$) of the set of hardness values, such that:

$$S_x=S_{x-1}+(H_x-m_h) \quad \text{Equation 1}$$

The mean hardness for the example hardness profile 400 of FIG. 4 is 425.03. Using this specific cumulative sum approach, the first cumulative difference ($S_0$) and the last cumulative data point were set to be zero. Applying Equation 1 to the hardness profile 400 of FIG. 4 results in:

$$S_1=S_0+(H_1-m_H)=0+(209-425.03)=-216.03 \quad \text{Equation 2}$$

$$S_2=S_1+(H_2-m_H)=-216.03+(196-425.03)=-445.05 \quad \text{Equation 3}$$

$$S_3=S_2+(H_3-m_H)=-445.05+(189-425.03)=-681.08 \quad \text{Equation 4}$$

And so on until . . .

$$S_{39}=S_{38}+(H_{39}-m_H)=-161.97+(587-425.03)=0.0 \quad \text{Equation 5}$$

The graph 501 plots the value of each sample along the y-axis. The x-axis represents the sample number. As the graph 501 shows, the plotted cumulative difference values resulted in a graph with one very apparent change in direction (peak 504). The change in direction represented a change, a potential change point, in the hardness profile.

However, the change may not be significant. To test, the random noise 502 was compared with the cumulative difference 500.

To generate the random noise 502, the order of the samples was changed to a random order. So instead of 1, 2, 3, 4 . . . 39, the sample order might be 2, 13, 23, 11, 24 . . . 32 or 4, 39, 2, 1 . . . 17. A plurality of these randomly ordered hardness profiles were created. For example, 1,000 random permutations of the hardness profile samples were generated. The cumulative difference for each of these randomly ordered hardness profiles was found by iteratively using Equation 1.

FIG. 5B is a graph 550 of a distribution of the difference between the maximum and minimum values of the cumulative difference of the randomly ordered hardness profiles. In the illustrated example, the maximum value of the cumulative difference 500 of the original samples was zero. The minimum value was −2404.49. Therefore, the difference between the maximum and the minimum values was 2404.49. The number of instances that the random data exceeds the difference of the maximum and the minimum value of the cumulative difference 500 reduces the likelihood there is a change point at the peak 504. In FIG. 5B, none of the random permutations exceeded the 2,404.49 value. Therefore, there was a 100% confidence that a change point occurred at sample 19 where the peak 504 was.

Figure 6:
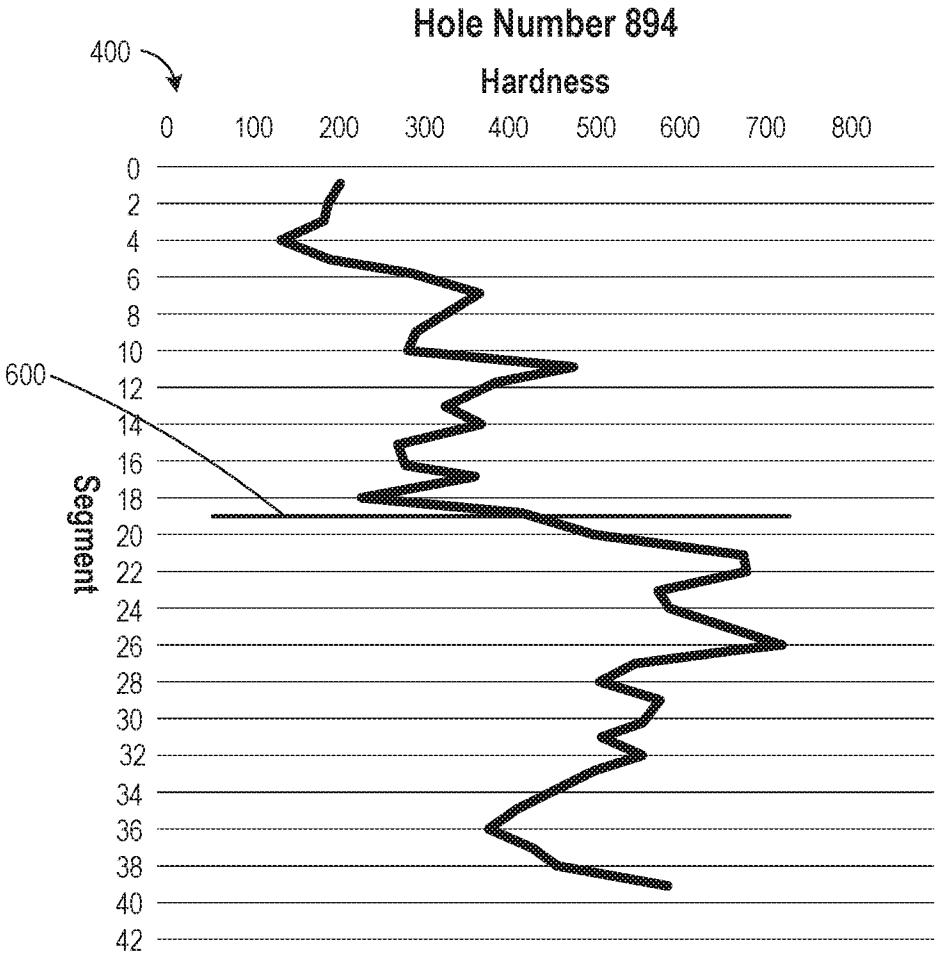
FIG. 6 illustrates the hardness profile of FIG. 4 with a first change point identified.

FIG. 6 illustrates the hardness profile 400 of FIG. 4 with a first change point 600 marked as identified by the iterative cumulative sum process discussed in FIGS. 5A-5B. The process used to find the first change point 600 was repeated on a subset of the samples.

Figure 7B:
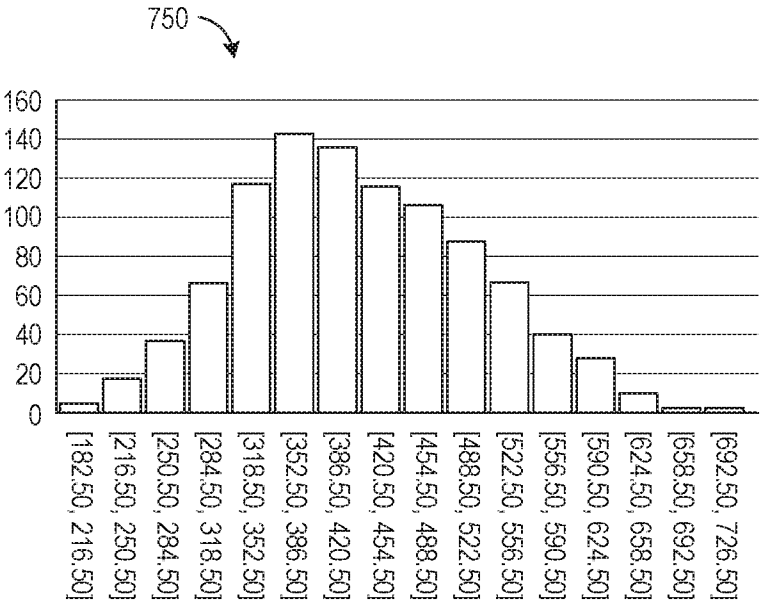
FIG. 7B depicts a graph of a distribution of the difference between the maximum and minimum values of the cumulative difference of the randomly ordered hardness profiles of FIG. 7A.
Figure 7A:
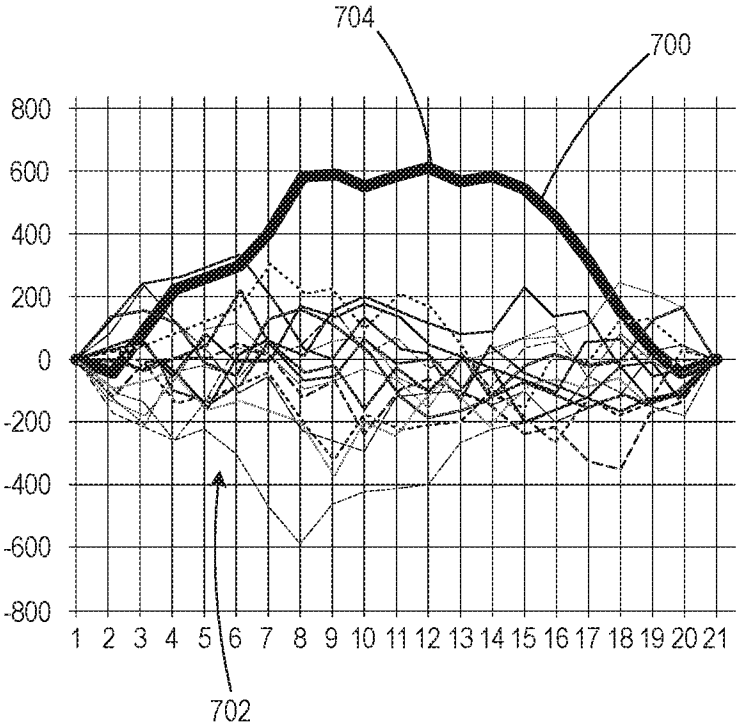
FIG. 7A illustrates a cumulative difference calculated for a subset of the hardness profile of FIG. 4, plotted against randomly ordered hardness profiles using the same hardness values of the same subset.

FIG. 7A illustrates a cumulative difference 700 for segments 20-39 of the hardness profile of FIG. 4 plotted with random noise 702. The random noise 702 was produced from the values of the same subset. A peak 704 of the cumulative difference 700 indicated that there may be a change point at that point in the blasthole. The random noise 702 was used to provide a confidence that the peak 704 represented a change point.

FIG. 7B is a graph 750 of a distribution of the difference between the maximum and minimum values of the cumulative difference of the randomly ordered hardness profiles. In the illustrated embodiment, the maximum value of the cumulative difference 700 of the original samples is −41.75. The minimum value is 607.25. Therefore, the difference between the maximum and the minimum values is 649. The number of instances that the random data exceeds the difference of the maximum and the minimum value of the cumulative difference 700 reduces the likelihood there is a change point and the peak 704. In FIG. 7B, only 1.1% of the random permutations exceeded the 649 value. Therefore, there was a 98.9% confidence that a change point occurred at segment 30 where the peak 704 was.

Figure 8:
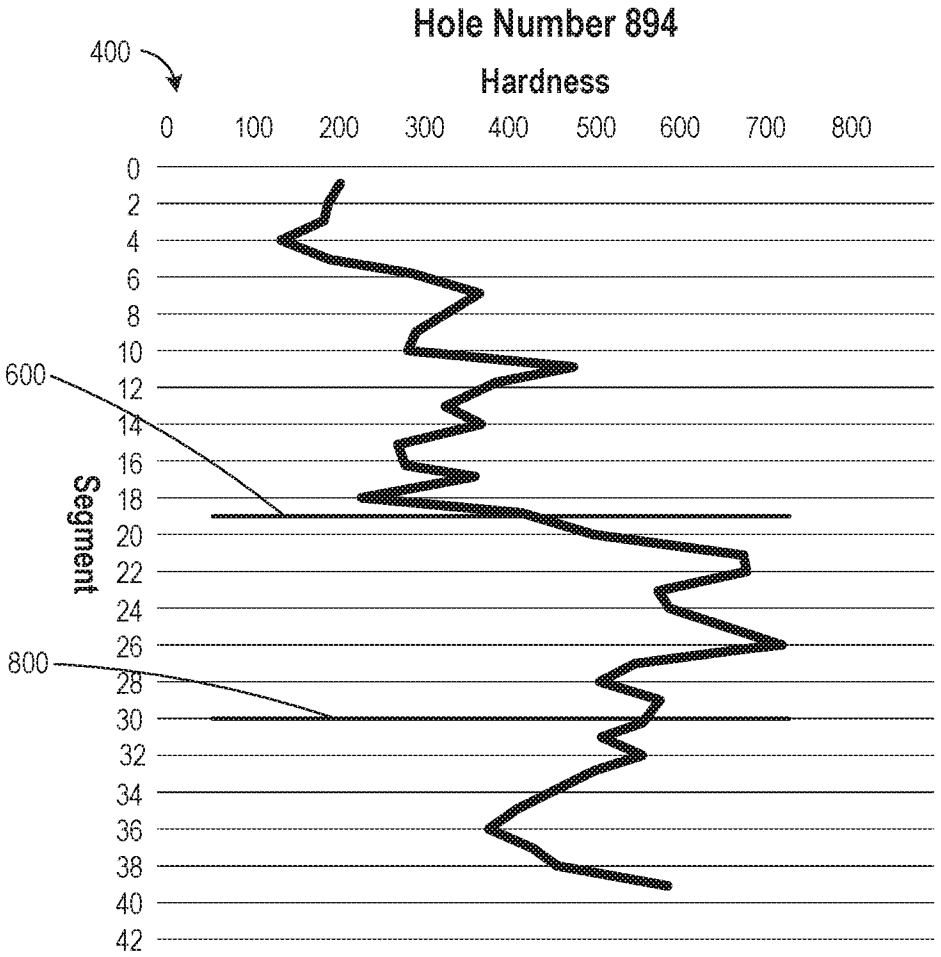
FIG. 8 illustrates the hardness profile of FIG. 4 with the first change point and a second change point identified.

FIG. 8 illustrates the hardness profile 400 of FIG. 4 with a first change point 600 and a second change point 800 marked as identified by the iterative cumulative sum process discussed in FIGS. 5A-5B and 7A-7B. The process used to find the first change point 600 was repeated on a subset of the samples. The subsets were bordered by at least one of the change points.

Figure 9B:
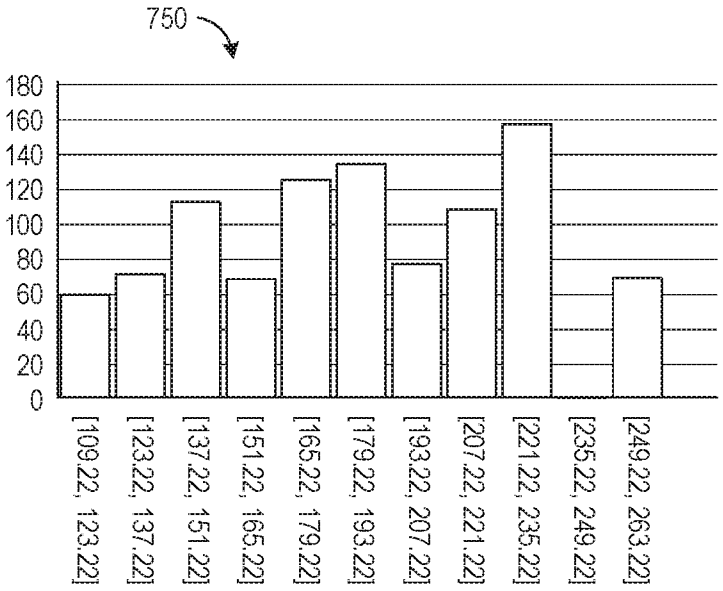
FIG. 9B depicts a graph of a distribution of the difference between the maximum and minimum values of the cumulative difference of the randomly ordered hardness profiles of FIG. 9A.
Figure 9A:
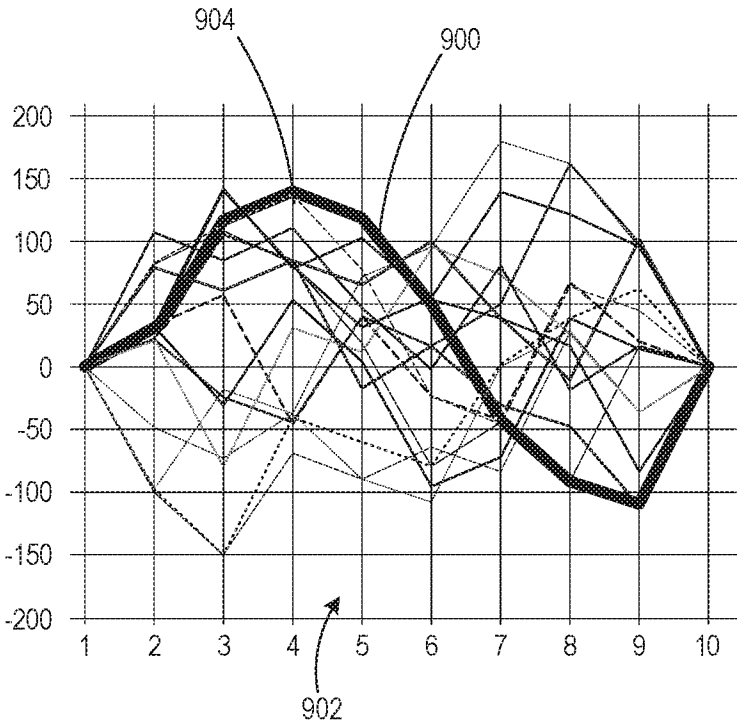
FIG. 9A illustrates a cumulative difference calculated for a further subset of the hardness profile of FIG. 4, plotted against randomly ordered hardness profiles using the same hardness values of the same further subset.

FIG. 9A illustrates a cumulative difference 900 for segments 31-39 of the hardness profile of FIG. 4 plotted with random noise 902. The random noise 902 was produced from the values of the same subset. The peak 904 of the cumulative difference 900 indicated that there was a potential change point at that point in the blasthole. The random noise 902 was used to provide a confidence level that the peak 904 represented a change point.

FIG. 9B is a graph 950 of a distribution of the difference between the maximum and minimum values of the cumulative difference of the random permutations. In the illustrated example, the difference between the maximum and the minimum values for the original data was 250.89. As illustrated in FIG. 9B, 7.1% of the random permutations exceeds the 250.89 value. Therefore, there was a 92.9% confidence that a change point occurred at segment 33 where the peak 904 was. In this example, the threshold was set to 95% confidence to reduce the false detection of change points. Therefore, segment 33 was not identified as a change point.

Figure 10:
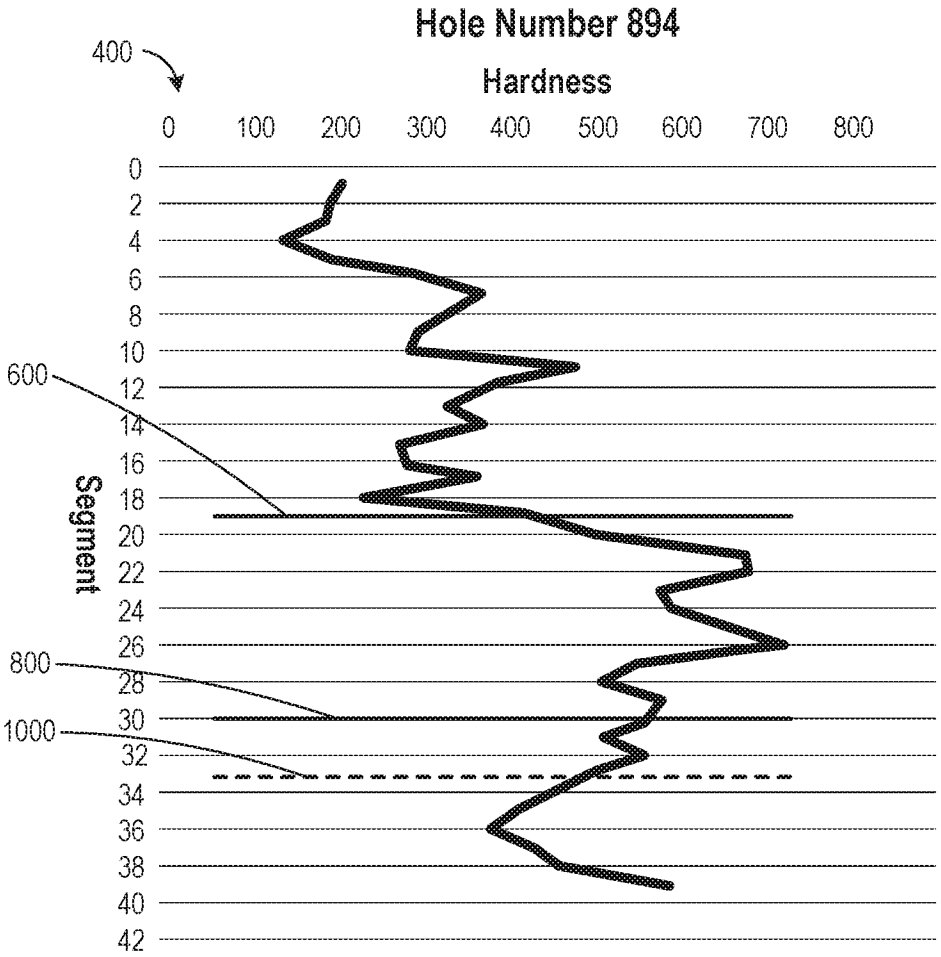
FIG. 10 illustrates the hardness profile of FIG. 4 with a first change point and a second change point identified and a non-change point identified.

FIG. 10 illustrates the hardness profile 400 of FIG. 4 with a first change point 600, a second change point 800, and a non-change point 1000 marked as identified by the iterative cumulative sum process discussed with reference to FIGS. 5A-5B, 7A-7B, and 9A-9B.

Figure 11:
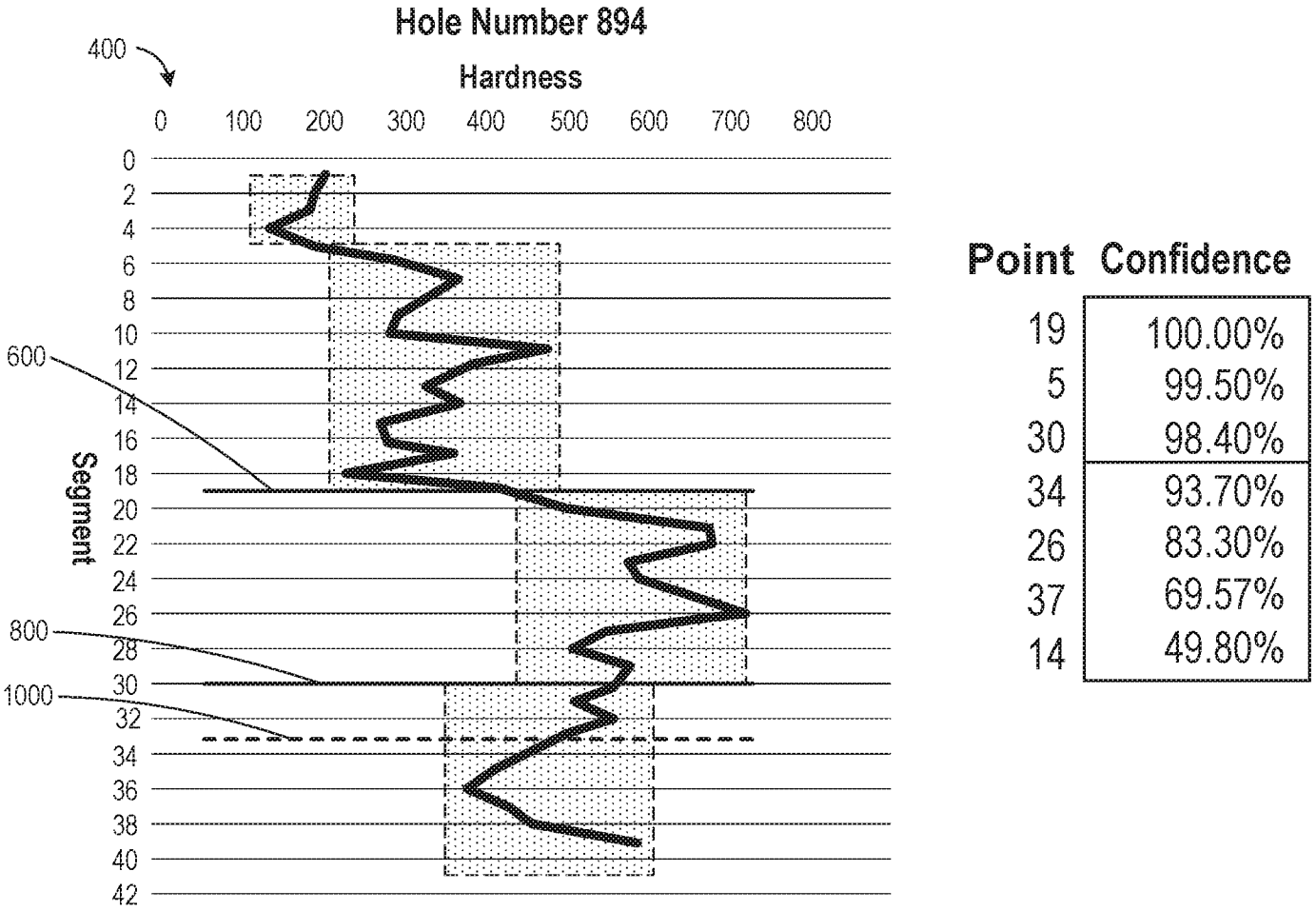
FIG. 11 illustrates the hardness profile of FIG. 4 after multiple hardness values subsets were analyzed for change points and three change points were identified.

The process used to find the change points was repeated on a subset of the samples, with the subset bordered by either change points, data boundaries (i.e., data point 0 or data point 42), or combinations thereof. The process was repeated on increasingly narrow subsets of samples, until a peak was identified for a particular subset that was not determined to be a change point. For example, after the non-change point 1000 was identified, data points 31-39 (i.e., hole depth from 31 feet to 39 feet) were not further evaluated for additional peaks or change points. FIG. 11 illustrates the hardness profile 400 of FIG. 4 after multiple subsets were analyzed for change points. Change points were found at segments 5, 19, and 30 with confidence levels of 99.5%, 100%, and 98.4%, respectively. Additional peaks were found that were determined to be non-change points at segments 14, 26, 34, and 37 with confidence levels of 49.8%, 83.3%, 93.7%, and 69.6%, respectively, Thus, prior to application of a stemming depth, four groups were identified. A representative hardness value for each of the groups would next be determined and a target emulsion density assigned.

Figure 12:
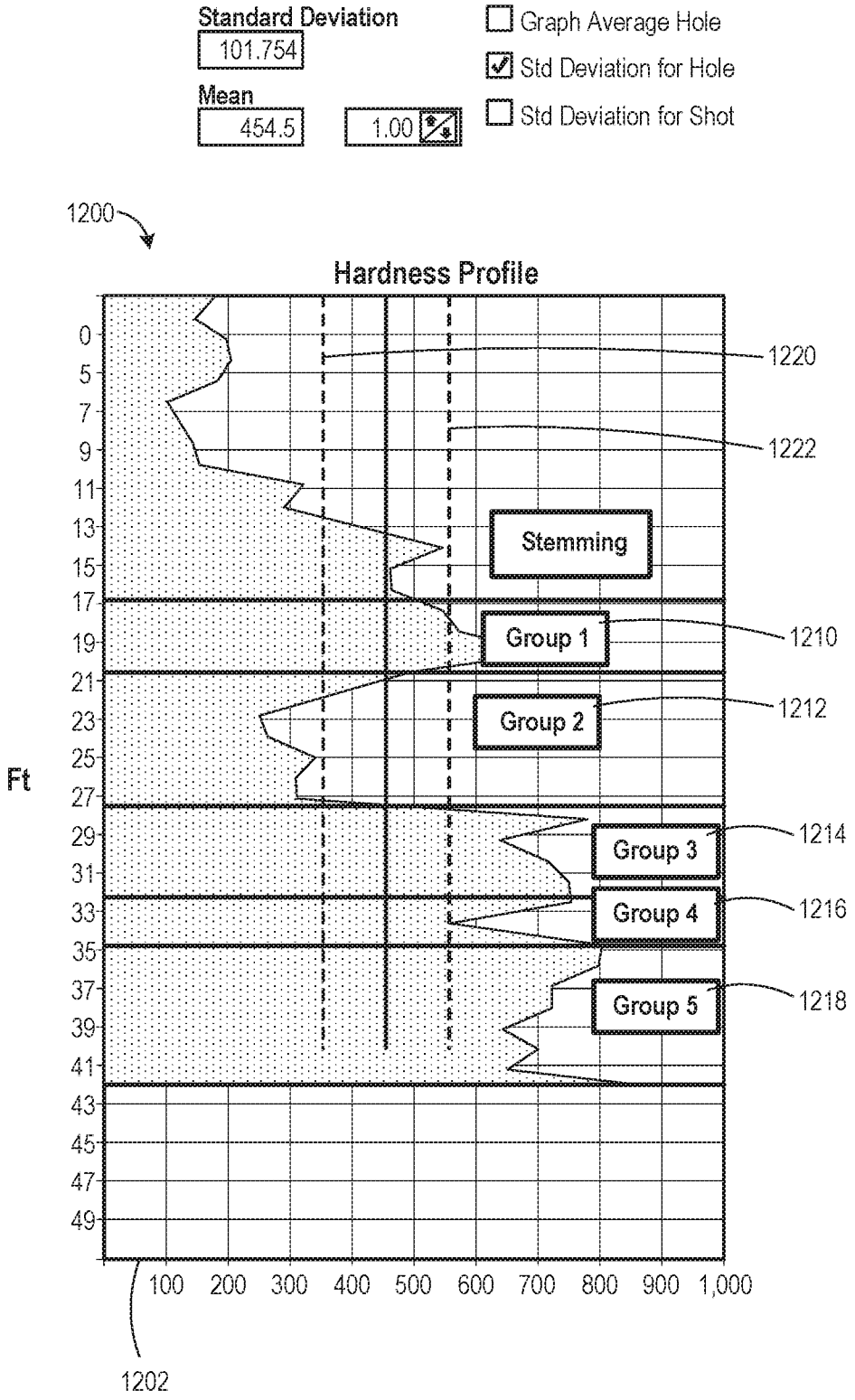
FIG. 12 illustrates another example hardness profile where three change points were identified at depths greater than the stemming line.

FIG. 12 illustrates another example hardness profile. The mean hardness value and standard deviation of that mean are depicted numerically and on the graph. Change points were identified for the hardness profile using the same process as applied to example hardness profile 400. The hardness data was segmented on a per-foot basis. A stemming depth of 17 feet was applied to the hardness profile. Three change points remained after application of the stemming depth. The change points were at about 22 feet, 25 feet, and 32 feet and defined four distinct groups. A representative hardness value would next be determined for each of the groups and a target emulsion density assigned.

Figure 13:
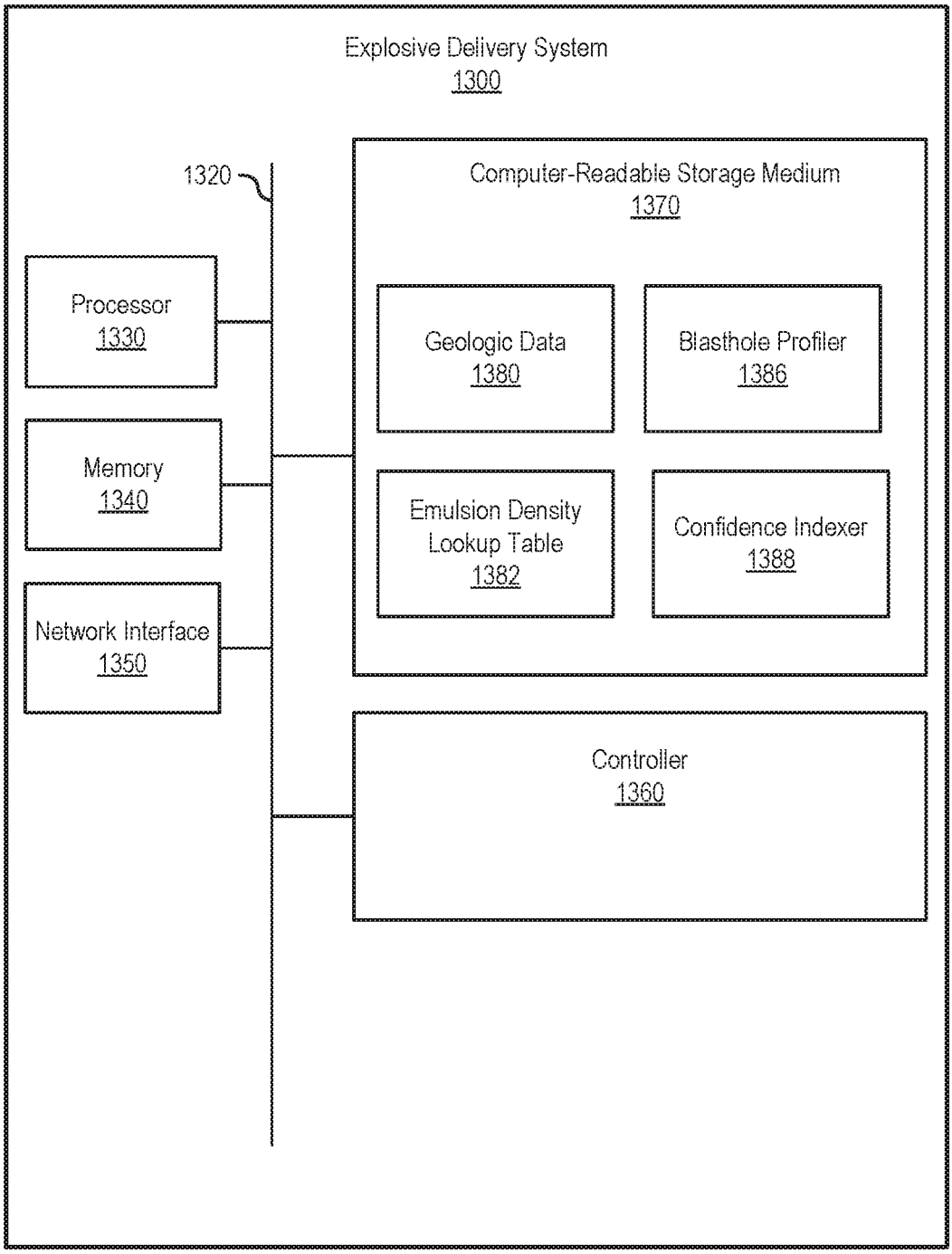
FIG. 13 illustrates a block diagram of an explosive delivery system for automatically varying the density of an emulsion matrix in a blasthole.

FIG. 13 illustrates a block diagram of an explosive delivery system 1300 for automatically varying the density of an emulsion matrix in a blasthole. As shown, the explosive delivery system 1300 may include a processor 1330, memory 1340, data interface 1350, and computer-readable storage medium 1370. A bus 1320 may interconnect various integrated and/or discrete components.

The processor 1330 may include one or more general-purpose devices, such as an Intel®, AMD®, or other standard microprocessor. The processor 1330 may include a special-purpose processing device, such as ASIC, SoC, SiP, FPGA, PAL, PLA, FPLA, PLD, or other customized or programmable device. The processor 1330 may perform distributed (e.g., parallel) processing to execute or otherwise implement functionalities of the presently disclosed embodiments.

The computer-readable storage medium 1370 may include static RAM, dynamic RAM, flash memory, one or more flip-flops, ROM, CD-ROM, DVD, disk, tape, or magnetic, optical, or other computer storage medium. The computer-readable storage medium 1370 may include geologic data 1380, and one or more programs to analyze the data.

For example, the computer-readable storage medium 1370 may comprise a blasthole profiler 1386, an emulsion density lookup table 1382, and a confidence indexer 1388. The blasthole profiler 1386 may receive dimensions of the blasthole and determine any change points within a geologic profile, wherein the geologic profile comprises hardness values representing hardness characteristics along a length of the blasthole. The blasthole profiler 1386 may also segment the blasthole into one or more groups separated by any identified change points. The confidence indexer 1388 may evaluate the strength of each change point. The emulsion density lookup table 1382 may be used to determine the target emulsion density within each group. A controller 1360 may prepare a signal to be sent to a mixer to cause the emulsion explosive to be a target density associated with a group of the blasthole being filled.

Table 1 list an example of the information that could be included in the emulsion density lookup table 1382. Table 1, for example, could be used with the groups (i.e., segments) identified in FIGS. 11 and 12 to determine the target emulsion density for each of the groups. For example, when an algorithm is used to calculate hardness values from drilling data, then the algorithm may also be used to approximate the target emulsion density for particular hardness values as part of generating Table 1. Likewise, variations of Table 1 utilizing geologic values in addition to or instead of hardness values could also be used. The approximations determined by the algorithm could then be confirmed or refined based on experience with actual test blasts in the material to be blasted.

TABLE 1

| Mine | Pit | Bench | Drill | Blasthole Diameter | Hardness Min | Hardness Max | Density |
|---|---|---|---|---|---|---|---|
| ABC | 1 | 2 | 046 | 12.25 | 100 | 200 | 1.06 |
| ABC | 1 | 2 | 046 | 12.25 | 201 | 300 | 1.08 |
| ABC | 1 | 2 | 046 | 12.25 | 301 | 400 | 1.10 |
| ABC | 1 | 2 | 046 | 12.25 | 401 | 500 | 1.12 |
| ABC | 1 | 2 | 046 | 12.25 | 501 | 600 | 1.14 |
| ABC | 1 | 2 | 046 | 12.25 | 601 | 700 | 1.16 |
| ABC | 1 | 2 | 046 | 12.25 | 701 | 800 | 1.18 |
| ABC | 1 | 2 | 046 | 12.25 | 801 | 900 | 1.20 |
| ABC | 1 | 2 | 046 | 12.25 | 901 | 1000 | 1.22 |
| ABC | 1 | 2 | 046 | 12.25 | 1001 | 1100 | 1.24 |
| ABC | 1 | 2 | 046 | 12.25 | 1101 | 1200 | 1.26 |
| ABC | 1 | 2 | 046 | 12.25 | 1201 | 1300 | 1.28 |
| ABC | 1 | 2 | 046 | 12.25 | 1301 | 1400 | 1.30 |
| ABC | 1 | 2 | 046 | 12.25 | 1401 | 1500 | 1.32 |

In some embodiments, the look up table can be tailored based on additional factors. For example, the variables of the lookup table may be varied based on the nature of the material in the ground (e.g., granite, sandstone, shale), the location of the mine, and current conditions. In some embodiments, the explosive delivery system may not find change points and instead use the average value of each blast hole and the look up table to identify an explosive density for each hole.

Figure 14:
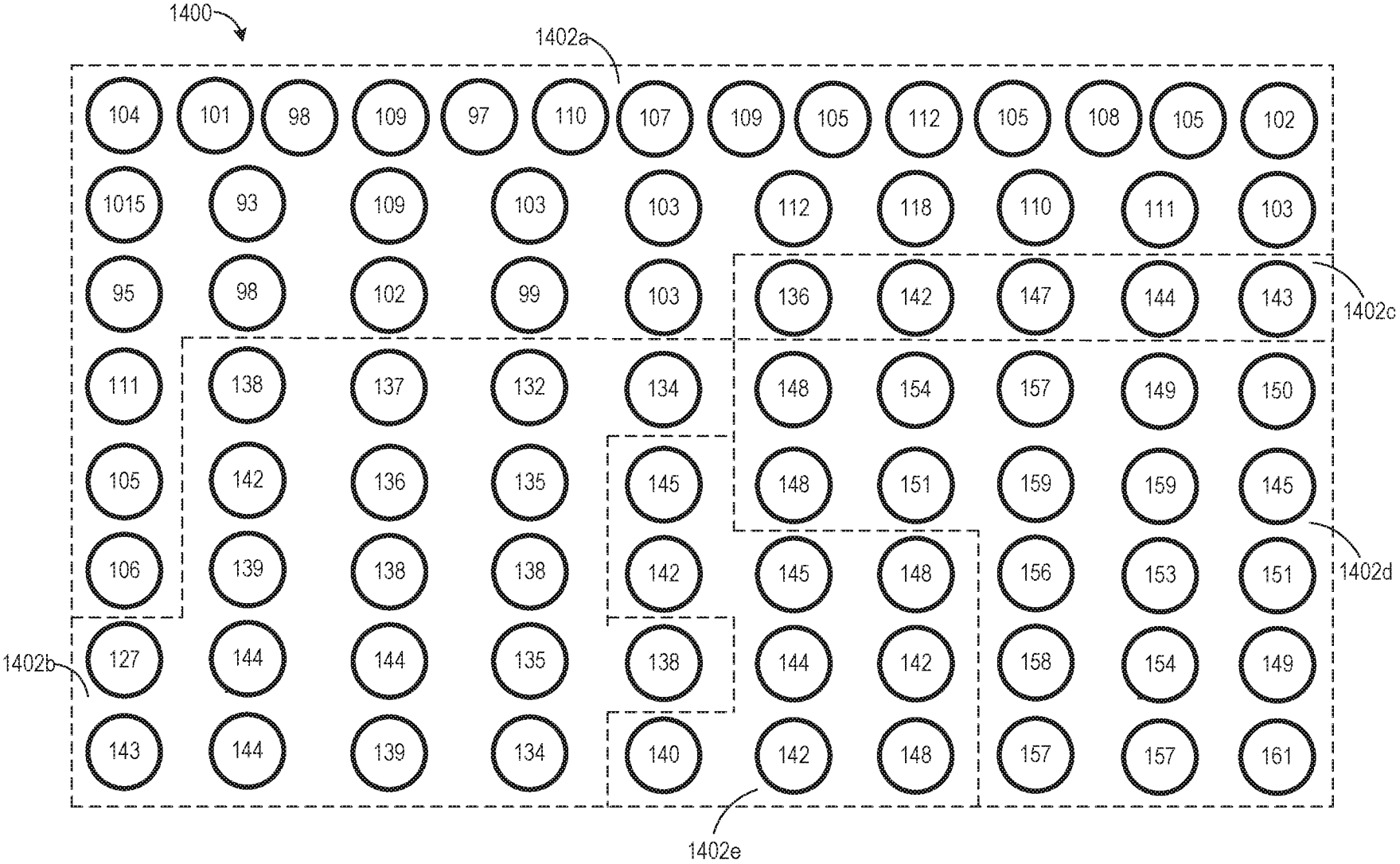
FIG. 14 illustrates a top view of a blast pattern showing the average hardness of each hole according to one embodiment.

FIG. 14 illustrates a top view of a blast pattern 1400 showing the average hardness of each hole according to one embodiment. An energy profile may be based on segmented and grouped blastholes. In the illustrated embodiment, the blast pattern has been segmented into five groups (e.g., 1402*a*-1402*e*). Each group represents one or more blastholes with similar hardness characteristics bordered by change points. The distance of the blast pattern 1400 where change points in the hardness values may be determined may be along each row or a line of holes in a burden direction. In some embodiments, change points may be determined in both spacing and burden directions of a blast pattern. In some embodiments, change points may be determined row by row. In some embodiments, an anchor blasthole may be used as a starting location, and change points are determined across a line in the blast plan at a plurality of angles.

Figure 15:
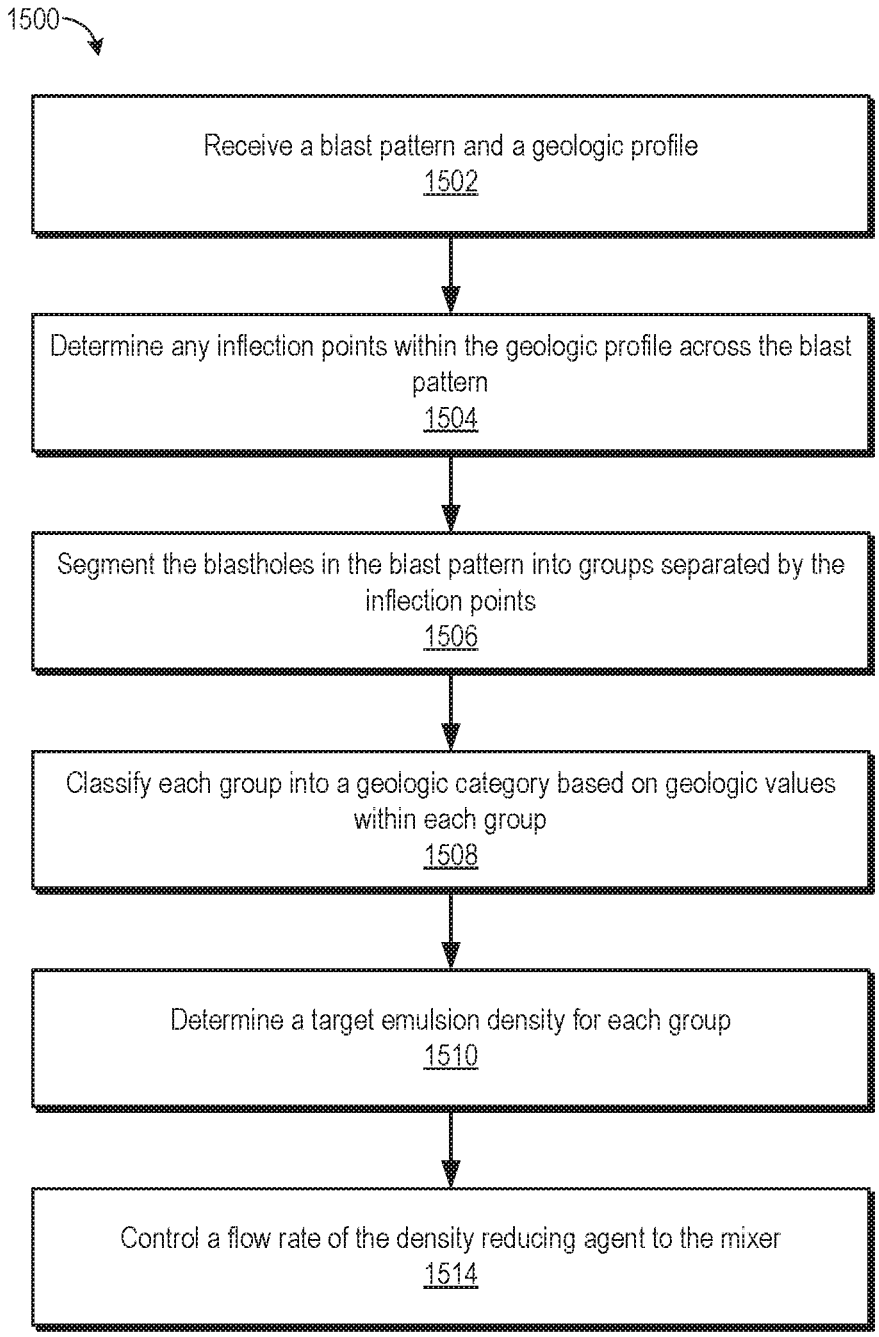
FIG. 15 illustrates a flow chart of one embodiment of a method of delivering explosives based on geological characteristics of a blasthole.

FIG. 15 illustrates a method of segmenting and grouping blastholes based on change points in geologic values, such as hardness values. FIG. 15 illustrates a flow chart of one embodiment of a method 1500 of delivering explosives. The method 1500 described with reference to FIG. 15 may be executed by processor circuitry, such as the processor circuitry 110 of FIG. 1.

In this embodiment, the method 1500 comprises receiving 1502 a geologic profile and a blast pattern. The geologic profile may include geologic values representing one or more geologic characteristics of the plurality of blastholes in the blast plan. In some embodiments, the method includes receiving drilling data comprising geologic hardness characteristics, a diameter of the blasthole, and a length of the blasthole. This information may be provided directly by data received during a drilling operation, or may be operator entered. In some embodiments, the method includes receiving seismic data. In some embodiments, the method 1500 includes generating a hardness profile based on drilling data and/or seismic data.

The method 1500 further includes determining 1504 any change points also sometimes referred to as inflection points within the geologic profile across the coordinates of the plurality of blastholes in the blast plan. See FIG. 4 for an illustration of how one embodiment finds change points within the geologic profile. In some geologic profiles there are no change points. This results in a single target emulsion density to be used for an entire blast plan. For clarification, even if there are no change points in hardness horizontally in the plan, the operator may still use multiple densities within each hole for the same reasons they may use multiple segments in any other blast. In other geologic profiles there are one or more change points, such as multiple change points resulting in multiple groups with one or more different target emulsion densities. For example, the change points may be determined using a sequential analysis technique, such as a cumulative sum technique, or other techniques that determine the confidence level of a change in momentum in a data series.

In some embodiments, the emulsion density may be varied within a blasthole. For example, a user may preselect a desired profile for blast holes in a blast pattern. The profile may be unique to each blasthole, may apply to all blast holes, or a group of blastholes. Thus the energy distribution within each hole may vary based on the preselected profile.

It should be understood that the disclosed methods of varying the explosive energy of explosives in a blasthole may be used to implement any number of desired explosive energy profiles of the sensitized product. For example, it may be desirable to have a lower density explosive at a top of a blasthole and a higher density explosive at a bottom of a blasthole. For example, the energy distribution of a blasthole may be roughly pyramidal. In another example, the energy profile may have a higher density explosive at the top of the blasthole. The resulting energy distribution of the blasthole may be an inverted pyramid. In yet another example, the explosive near a middle section of the blasthole may have a higher density than the top or the bottom, resulting in a convex shaped energy distribution.

The method 1500 further includes segmenting 1506 the plurality of blastholes into one or more groups separated by any identified change points across the coordinates of the plurality of blastholes. The method 1500 further includes determining 1508 a representative geologic value for each group. The representative geologic value may be defined by a probability distribution, an average geologic value, a maximum geologic value, or a minimum geologic value for a particular group. Examples of a probability distribution include the mean, median, or mode of the geologic values for a particular group.

The method 1500 further includes determining 1510 a target explosive energy value, such as a target emulsion density, for each group based on the representative geologic value for each group, thereby generating a target explosive energy profile comprising target explosive energy values for each blasthole in the plurality of blastholes. In some embodiments, determining the target explosive energy value for each group comprises accessing a table and locating the target explosive energy value based on the representative geologic value associated with each group. The table can include target explosive energy values for a plurality of geologic values.

The target explosive energy values may be found from an algorithm, based on previous experience, or a combination thereof. For example, in embodiments where an algorithm is used to generate the hardness profile from drilling data and/or seismic data, the hardness values generated may be relative values, not absolute values. When relative values are generated, then it may be beneficial to conduct one or more test charges in the blast site and compare the performance of different target explosive energy values at particular hardness values within the test blastholes. For example, in such a manner, the target emulsion densities correlated with particular hardness values can be fine-tuned. Or stated another way, the output of the algorithm used to generate the hardness profile can be fine-tuned with one or more test blasts. Thus, the target emulsion densities generate a target density profile comprising target emulsion density values along the length of the blasthole. The target energy profile, such as a target density profile, may be modified with a stemming length, an air decking location and length, other regions devoid of emulsion explosive, or combinations thereof.

The method 1500 may further include controlling 1514 a flow rate of the energy-modulating agent to the mixer to achieve the target explosive energy value for the group associated with a blasthole being filled. For example, the method 1500 may determine the blasthole based on GPS location, or in relation to a previous blasthole, and adjust the explosive to the target explosive energy value associated with the group of which the blasthole is a part, such as by adjusting the density of the explosive when the explosive contains an emulsion explosive.

The method 1500 may further include the operator confirming or inputting the depth of any water present in the blasthole. The target emulsion density for explosives in contact with water may be automatically increased to greater than 1 g/cm$^3$, if the target emulsion density for the group was not already greater than 1 g/cm$^3$.

In some embodiments, only a portion of the steps of the method 1500 may be performed. For example, when the geologic profile is generated, rather than received, then step 1502 may not be performed. In yet another example, in some embodiments only steps 1504-1510 may be performed. Additionally, in some embodiments, some of the steps of the method 1500 may be combined together into a single step.

Figure 16:
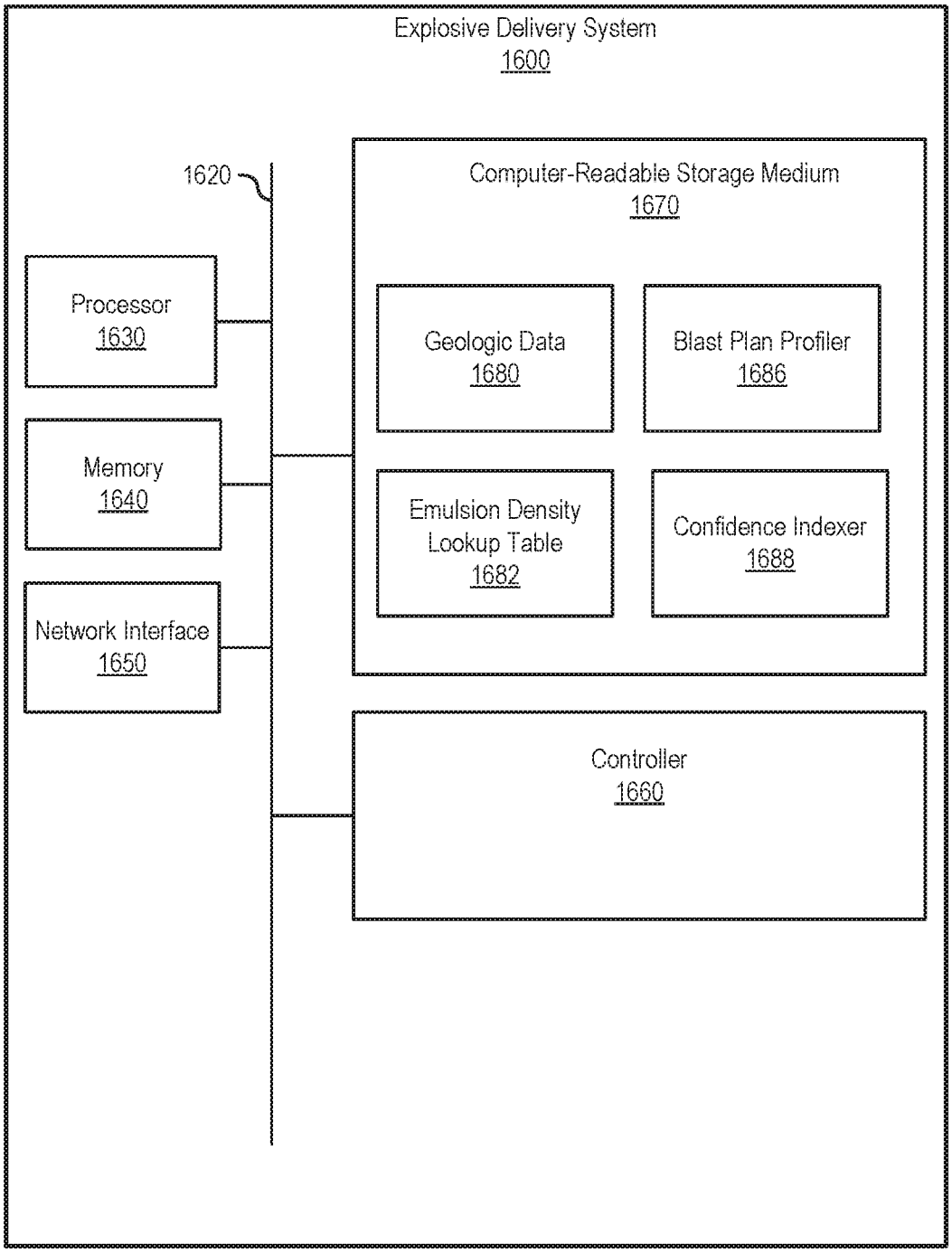
FIG. 16 illustrates a block diagram of an explosive delivery system for automatically varying the density of an emulsion matrix.

FIG. 16 illustrates a block diagram of an explosive delivery system 1600 for automatically varying the density of an emulsion matrix in between blastholes in a blast pattern. As shown, the explosive delivery system 1600 may include a processor 1630, memory 1640, data interface 1650, and computer-readable storage medium 1670. A bus 1620 may interconnect various integrated and/or discrete components.

The processor 1630 may include one or more general-purpose devices, such as an Intel®, AMD®, or other standard microprocessor. The processor 1630 may include a special-purpose processing device, such as ASIC, SoC, SiP, FPGA, PAL, PLA, FPLA, PLD, or other customized or programmable device. The processor 1630 may perform distributed (e.g., parallel) processing to execute or otherwise implement functionalities of the presently disclosed embodiments.

The computer-readable storage medium 1670 may include static RAM, dynamic RAM, flash memory, one or more flip-flops, ROM, CD-ROM, DVD, disk, tape, or magnetic, optical, or other computer storage medium. The computer-readable storage medium 1670 may include geologic data 1680, and one or more programs to analyze the data.

For example, the computer-readable storage medium 1670 may comprise a blast plan profiler 1686, an emulsion density lookup table 1682, and a confidence indexer 1688. The blast plan profiler 1686 may receive dimensions of the blast plan and location of blastholes and determine any change points within a geologic profile of the blast plan. In some embodiments, the geologic profile comprises an average geologic value for each blasthole. The blast plan profiler 1686 may also segment the blastholes of the blast plan into one or more groups separated by any identified change points. The confidence indexer 1688 may evaluate the strength of each change point. The emulsion density lookup table 1682 may be used to determine the target emulsion density within each group. A controller 1660 may prepare a signal to be sent to a mixer to cause the emulsion explosive to be a target density associated with the blasthole being filled.

Table 1 lists an example of the information that could be included in the emulsion density lookup table 1682. Table 1, for example, could be used with the groups (i.e., segments) identified in method 300 to determine the target emulsion density for each of the groups. For example, when an algorithm is used to calculate hardness values from drilling data, then the algorithm may also be used to approximate the target emulsion density for particular hardness values as part of generating Table 1. Likewise, variations of Table 1 utilizing geologic values in addition to or instead of hardness values could also be used. The approximations determined by the algorithm could then be confirmed or refined based on experience with actual test blasts in the material to be blasted.

EXAMPLES

Example 1

An explosive delivery system comprising: a first reservoir configured to store an energy-modulating agent; a second reservoir configured to store an energetic substance; a mixer configured to combine the energetic substance and the energy-modulating agent into an explosive, the mixer operably connected to the first reservoir and the second reservoir; a delivery device operably connected to the mixer, the first reservoir, and the second reservoir, wherein the delivery device is configured to deliver the explosive into a blasthole; and processor circuitry to: receive a blast pattern comprising location data of a plurality of blastholes; receive geologic values associated with the plurality of blastholes; segment the blast pattern into one or more groups of blastholes; determine a target explosive energy for each group of blastholes based on a representative geologic value for each group of blastholes, thereby generating a target energy profile comprising target explosive energy values for each blasthole in the plurality of blastholes; and control a flow rate of the energy-modulating agent to the mixer to deliver, via the delivery device, the explosive with a target explosive energy value to the blasthole according to the target energy profile.

Example 2

The explosive delivery system of example 1, wherein the geologic values represent geologic characteristics of the plurality of blastholes, and wherein the geologic values comprise an average geologic value for each of the plurality of blastholes.

Example 3

The explosive delivery system of example 1, wherein an available amount of explosive material is used to determine the target explosive energy for each group.

Example 4

The explosive delivery system of example 1, wherein the processor circuitry is to determine any change points in the geologic values along a distance of the blast pattern.

Example 5

The explosive delivery system of example 4, wherein the distance of the blast pattern where the processor circuitry is to determine any change points in the geologic values comprises a row of blastholes.

Example 6

The explosive delivery system of example 5, wherein the processor circuitry is to determine change points for each row of blastholes, and segment each row of blastholes.

Example 7

The explosive delivery system of example 1, wherein the processor circuitry is further to: determine that the explosive has been delivered to a first group of blastholes at a first energy value and that the explosive is to be delivered at a second energy value to a second group of blastholes; and modify the flow rate of the energy-modulating agent such that the explosive delivered by the delivery device to the second group of blastholes has the target explosive energy value associated with the second group of blastholes.

Example 8

The explosive delivery system of any of examples 1-7, further comprising a memory storage device to store a table comprising target explosive energy values for a plurality of representative geologic values, wherein to determine the target explosive energy value for each group of blastholes, the processor circuitry accesses the table and locates the target explosive energy value based on the representative geologic value associated with each group of blastholes.

Example 9

The explosive delivery system of example 8, wherein the target explosive energy value associated with each representative geologic value is based at least partially on blast performance from one or more test charges.

Example 10

The explosive delivery system of any one of examples 1-9, wherein the energy-modulating agent comprises a density-reducing agent, wherein the energetic substance comprises an emulsion matrix, wherein the explosive comprises an emulsion explosive, wherein the target explosive energy values comprise target emulsion density values for each of the blastholes, and wherein the target energy profile comprises a target density profile for each of the blastholes.

Example 11

The explosive delivery system of example 10, wherein the density-reducing agent comprises a chemical gassing agent.

Example 12

The explosive delivery system of any one of examples 1-11, wherein the processor circuitry is further to receive the geologic profile.

Example 13

The explosive delivery system of any one of examples 1-12, wherein the processor circuitry is further to generate the geologic profile from geologic data.

Example 14

The explosive delivery system of example 13, wherein the processor circuitry is further to receive drilling data, drill cutting data, core sample data, seismic data, or combinations thereof.

Example 15

The explosive delivery system of example 13, wherein the processor circuitry is further to determine the geologic data directly or indirectly from one or more sources.

Example 16

The explosive delivery system of any one of examples 1-15, wherein the processor circuitry is further to determine the representative geologic value for each group.

Example 17

The explosive delivery system of example 16, wherein the representative geologic value is defined by a probability distribution, a maximum value, or a minimum value.

Example 18

The explosive delivery system of any one of examples 1-17, wherein the delivery device comprises a delivery conduit and the mixer is located proximal an outlet of the delivery conduit.

Example 19

The explosive delivery system of example 18, wherein the delivery conduit is configured to introduce a density-reducing agent to an emulsion matrix proximal an inlet of the mixer.

Example 20

The explosive delivery system of any one of examples 1-18, wherein the energy-modulating agent comprises ammonium nitrate fuel oil (ANFO).

Example 21

The explosive delivery system of any one of examples 1-20, wherein the processor circuitry to segment the blast pattern into one or more groups of blastholes is to segment the blast pattern into one or more groups of blastholes separated by any identified change points.

Example 22

A method of delivering explosives comprising: receiving a blast pattern comprising coordinates of a plurality of blastholes; receiving a geologic profile comprising geologic values representing geologic characteristics of the plurality of blastholes; determining any change points in the geologic values across the coordinates of the plurality of blastholes; segmenting the plurality of blastholes into one or more groups separated by any identified change points across the coordinates of the plurality of blastholes; determining a target explosive energy value for each group based on a representative geologic value for each group, thereby generating a target explosive energy profile comprising target explosive energy values for each blasthole in the plurality of blastholes; and delivering an explosive into the plurality of blastholes with explosive energy values according to the target explosive energy profile.

Example 23

The method of delivering explosives of example 22, wherein determining any change points comprises: calculating a cumulative difference between geologic values for each of the plurality of blastholes and a mean of the geologic values for all of the plurality of blastholes, wherein an order of the geologic values for each of the plurality of blastholes is based on the coordinates of the plurality of blastholes; and determining a first peak value of the cumulative difference.

Example 24

The method of delivering explosives of example 23, further comprising comparing the first peak value to statistical noise in the geologic values for each of the plurality of blastholes and identifying the first peak value as a change point if the first peak value exceeds statistical noise.

Example 25

The method of delivering explosives of example 24, wherein comparing the first peak value to statistical noise in the geologic values for each of the plurality of blastholes and identifying the first peak value as a change point if the first peak value exceeds statistical noise comprises: randomizing the geologic values for each of the plurality of blastholes to generate a plurality of randomly ordered geologic profiles; calculating a cumulative difference and peak value for each of the plurality of randomly ordered geologic profiles; determining the percentage of random peak values that exceed the first peak value; and identifying the first peak value as a change point if the percentage is less than a selected confidence value.

Example 26

The method of delivering explosives of any one of examples 22-26, further comprising identifying any additional change points by iteratively determining additional peak values of portions of the geologic values bounded by one or more previously determined change points and comparing each of the additional peak values to statistical noise in the relevant portions of the geologic values for each of the plurality of blastholes, and identifying each of the additional peak values as a change point if each of the additional peak values exceeds statistical noise.

Example 27

The method of delivering explosives of any one of examples 22-26, wherein determining a target explosive energy value for each group based on a representative geologic value for each group comprises determining a target emulsion density value for each group based on the representative geologic value for each group and wherein the target explosive energy profile comprises a target emulsion explosive density profile.

Example 28

A non-transitory computer-readable media comprising instructions to cause, upon execution of the instructions by one or more processors, an explosive delivery system to: receive dimensions of a blast pattern; determine any change points within a geologic profile, wherein the geologic profile comprises geologic values representing geologic characteristics in each blasthole of the blast pattern; segment the blast pattern into one or more groups of blastholes separated by any identified change points; and determine a target emulsion density for each group of blastholes based on a representative geologic value, thereby generating a target density profile comprising target emulsion density values for each blasthole of the blast pattern.

Example 29

The non-transitory computer-readable media of example 28, further comprising controlling delivery of an emulsion explosive into a blasthole with a density value according to the target density profile.

Example 30

A method of determining an emulsion explosive density profile for a blasthole, the method comprising: determining any change points within a geologic profile, wherein the geologic profile comprises geologic values representing geologic characteristics along a length of the blasthole; segmenting the blasthole into one or more groups separated by any identified change points; and determining a target emulsion density for each group based on a representative geologic value for each group, thereby generating a target density profile comprising target emulsion density values along the length of the blasthole.

Example 31

An explosive delivery system comprising: a first reservoir configured to store an energy-modulating agent; a second reservoir configured to store an energetic substance; a mixer configured to combine the energetic substance and the energy-modulating agent into an explosive, the mixer operably connected to the first reservoir and the second reservoir; a delivery device operably connected to the mixer, the first reservoir, and the second reservoir, wherein the delivery device is configured to deliver the explosive into a blasthole; and processor circuitry to: receive a blast pattern comprising location data of a plurality of blastholes; receive geologic values associated with the plurality of blastholes; compare the geological values to values on a look-up table to determine a target explosive energy for each blasthole based on an average geologic value for each blasthole, thereby generating a target energy profile comprising target explosive energy values for each blasthole in the plurality of blastholes; and control a flow rate of the energy-modulating agent to the mixer to deliver, via the delivery device, the explosive with a target explosive energy value to the blasthole according to the target energy profile.

Example 32

The explosive delivery system of example 31, wherein target explosive energy values in the look-up table vary based on type of material in ground and location of the blast pattern.

Example 33

The explosive delivery system of any one of examples 1 or 31, further comprising determining density variation for the target energy profile for each blasthole based on a preselected profile.

Example 34

An explosive delivery system comprising: a first reservoir configured to store an energy-modulating agent; a second reservoir configured to store an energetic substance; a mixer configured to combine the energetic substance and the energy-modulating agent into an explosive, the mixer operably connected to the first reservoir and the second reservoir; a delivery device operably connected to the mixer, the first reservoir, and the second reservoir, wherein the delivery device is configured to deliver the explosive into a blasthole; and processor circuitry to: receive dimensions of the blasthole; determine any change points within a geologic profile, wherein the geologic profile comprises geologic values representing geologic characteristics along a length of the blasthole; segment the blasthole into one or more groups separated by any identified change points; determine a target explosive energy for each group based on a representative geologic value for each group, thereby generating a target energy profile comprising target explosive energy values along the length of the blasthole; and control a flow rate of the energy-modulating agent to the mixer to vary an energy of the explosive as needed according to the target energy profile.

Example 35

The explosive delivery system of example 34, wherein the processor circuitry is further to: determine that a first explosive group at a first energy value has been delivered to the blasthole and that a second explosive group at a second energy value is to be delivered to the blasthole; and modify the flow rate of the energy-modulating agent such that the explosive delivered by the delivery device has the target explosive energy value associated with the second explosive group.

Example 36

The explosive delivery system of example 34 or example 35, further comprising a memory storage device to store a table comprising target explosive energy values for a plurality of representative geologic values, wherein to determine the target explosive energy value for each group, the processor circuitry accesses the table and locates the target explosive energy value based on the representative geologic value associated with each group.

Example 37

The explosive delivery system of example 36, wherein the target explosive energy value associated with each representative geologic value is based at least partially on blast performance from one or more test charges.

Example 38

The explosive delivery system of any one of examples 34-37, wherein the energy-modulating agent comprises a density-reducing agent, wherein the energetic substance comprises an emulsion matrix, wherein the explosive comprises an emulsion explosive, wherein the target explosive energy values comprise target emulsion density values, and wherein the target explosive energy profile comprises a target density profile.

Example 39

The explosive delivery system of example 35, wherein the density-reducing agent comprises a chemical gassing agent.

Example 40

The explosive delivery system of any one of examples 34-39, wherein the processor circuitry is further to receive the geologic profile.

Example 41

The explosive delivery system of any one of examples 34-40, wherein the processor circuitry is further to generate a geologic profile based on geologic hardness characteristics.

Example 42

The explosive delivery system of example 41, wherein the processor circuitry is further to receive drilling data, a diameter of the blasthole, and the length of the blasthole.

Example 43

The explosive delivery system of any one of examples 34-42, wherein the processor circuitry is further to determine the representative geologic value for each group.

Example 44

The explosive delivery system of example 43, wherein the representative geologic is defined by a probability distribution, a maximum value, or a minimum value.

Example 45

The explosive delivery system of any one of examples 34-44, wherein the processor circuitry is further to monitor a delivery rate of an emulsion matrix to determine, based on the dimensions of the blasthole, a current group of the blasthole.

Example 46

The explosive delivery system of any one of examples 34-45, wherein the delivery device comprises a delivery conduit and the mixer is located proximal an outlet of the delivery conduit.

Example 47

The explosive delivery system of example 46, wherein the delivery conduit is configured to introduce a density-reducing agent to an emulsion matrix proximal an inlet of the mixer.

Example 48

A method of delivering explosives comprising: receiving dimensions of a blasthole; determining any change points within a geologic profile, wherein the geologic profile comprises geologic values representing geologic characteristics along a length of the blasthole; segmenting the blasthole into one or more groups separated by any identified change points; determining a target explosive energy value for each group based on a representative geologic value for each group, thereby generating a target explosive energy profile comprising target explosive energy values along the length of the blasthole; and delivering an explosive into the blasthole with explosive energy values according to the target explosive energy profile.

Example 49

The method of delivering explosives of example 48, wherein determining any change points comprises: calculating a cumulative difference between actual geologic values and a mean of the geologic values for the blasthole; and determining a first peak value of the cumulative difference.

Example 50

The method of delivering explosives of example 49, further comprising comparing the first peak value to statistical noise in the actual geologic values and identifying the first peak value as a change point if the first peak value exceeds statistical noise.

Example 51

The method of delivering explosives of example 50, wherein comparing the first peak value to statistical noise in the actual geologic values and identifying the first peak value as a change point if the first peak value exceeds statistical noise comprises: randomizing the actual geologic values to generate a plurality of randomly ordered geologic profiles; calculating a cumulative difference and peak value for each of the plurality of randomly ordered geologic profiles; determining the percentage of random peak values that exceed the first peak value; and identifying the first peak value as a change point if the percentage is less than a selected confidence value.

Example 52

The method of delivering explosives of any one of examples 48-51, further comprising identifying any additional change points by iteratively determining additional peak values of portions of the geologic values bounded by one or more previously determined change points and comparing each of the additional peak values to statistical noise in the relevant portions of the actual geologic values, and identifying each of the additional peak values as a change point if each of the additional peak values exceeds statistical noise.

Example 53

The method of delivering explosives of any one of examples 48-52, wherein determining a target explosive energy value for each group based on a representative geologic value for each group comprises determining a target emulsion density value for each group based on the representative geologic value for each group and wherein the target explosive energy profile comprises a target emulsion explosive density profile, and further comprising determining a maximum number of density changes achievable by delivery system equipment, a control system, or both.

Example 54

The method of delivering explosives of example 53, wherein determining the maximum number of density changes achievable by the delivery system equipment comprises evaluating the following: parameters of the blasthole, flow rate of delivery system equipment, and control system for the delivery system equipment.

Example 55

The method of delivering explosives of example 54, wherein the parameters of the blasthole include a blasthole length and a blasthole diameter.

Example 56

The method of delivering explosives of any one of example 48-55, further comprising modifying the target explosive energy profile with a stemming length, an air decking location and length, another region devoid of explosive, or combinations thereof.

Example 57

The method of delivering explosives of any one of examples 48-56, wherein no change points are identified and a single target explosive energy value is used for the blasthole.

Example 58

The method of delivering explosives of any one of examples 48-57, wherein multiple change points are identified, resulting in multiple groups with different explosive energy values.

Example 59

The method of delivering explosives of any one of examples 48-58, wherein there are three or more different groups.

Example 60

A non-transitory computer-readable media comprising instructions to cause, upon execution of the instructions by one or more processors, an explosive delivery system to: receive dimensions of a blasthole; determine any change points within a geologic profile, wherein the geologic profile comprises geologic values representing geologic characteristics along a length of the blasthole; segment the blasthole into one or more groups separated by any identified change points; and determine a target emulsion density for each group based on a representative geologic value, thereby generating a target density profile comprising target emulsion density values along the length of the blasthole.

Example 61

The non-transitory computer-readable media of example 60, further comprising controlling delivery of an emulsion explosive into a blasthole with density values according to the target density profile.

Example 62

A method of determining an emulsion explosive density profile for a blasthole, the method comprising: determining any change points within a geologic profile, wherein the geologic profile comprises geologic values representing geologic characteristics along a length of the blasthole; segmenting the blasthole into one or more groups separated by any identified change points; and determining a target emulsion density for each group based on a representative geologic value for each group, thereby generating a target density profile comprising target emulsion density values along the length of the blasthole.

Example 63

A method of delivering explosives comprising: receiving dimensions of a blasthole; determining any change points within a geologic profile; segmenting the geologic profile into one or more groups separated by any identified change points; determining a target explosive energy value for each group based on a representative geologic value for each group, thereby generating a target explosive energy profile comprising target explosive energy values for each group; and delivering an explosive with explosive energy values according to the target explosive energy profile.

Example 64

The method of delivering explosives of example 63, wherein the wherein the geologic profile comprises geologic values representing geologic characteristics along a length of the blasthole.

Example 65

The method of delivering explosives of example 63, wherein the wherein the geologic profile comprises geologic values representing geologic characteristics along a blast pattern.

One of ordinary skill in the art, with the benefit of this disclosure, would understand that the systems and methods disclosed herein may also include other components and method steps. For example, delivery system equipment, such as the truck 102 described herein, may include additional reservoirs for containing additional explosive additives, such as a pH control agent and/or a gassing accelerator, operably connected to the other delivery systems of the truck 102. Likewise, delivery system equipment, such as the truck 102, may include additional equipment such as homogenizers, additional mixers, etc. All of these additional components may be controlled by the control systems described herein.

The examples and embodiments disclosed herein are to be construed as merely illustrative and exemplary and not a limitation of the scope of the present disclosure in any way. It will be apparent to those having skill in the art, and having the benefit of this disclosure, that changes may be made to the details of the above-described embodiments without departing from the underlying principles of the disclosure herein.

The invention claimed is:

1. A method of delivering explosives comprising:

receiving dimensions of a blasthole;

determining any change points within a geologic profile, wherein determining any change points comprises:

calculating a cumulative difference between actual geologic values and a mean of the geologic values; and determining a first peak value of the cumulative difference;

segmenting the geologic profile into one or more groups separated by any identified change points;

determining a target explosive energy value for each group based on a representative geologic value for each group, thereby generating a target explosive energy profile comprising target explosive energy values for each group; and delivering an explosive with explosive energy values according to the target explosive energy profile.

2. The method of delivering explosives of claim 1, wherein the wherein the geologic profile comprises geologic values representing geologic characteristics along a length of the blasthole.

3. The method of delivering explosives of claim 1, wherein the wherein the geologic profile comprises geologic values representing geologic characteristics along a blast pattern.

4. The method of delivering explosives of claim 1, further comprising comparing the first peak value to statistical noise in the actual geologic values and identifying the first peak value as a change point if the first peak value exceeds statistical noise.

5. The method of delivering explosives of claim 4, wherein comparing the first peak value to statistical noise in the actual geologic values and identifying the first peak value as a change point if the first peak value exceeds statistical noise comprises:

randomizing the actual geologic values to generate a plurality of randomly ordered geologic profiles;

calculating a cumulative difference and peak value for each of the plurality of randomly ordered geologic profiles;

determining the percentage of random peak values that exceed the first peak value; and identifying the first peak value as a change point if the percentage is less than a selected confidence value.

6. The method of delivering explosives of claim 1, wherein determining a target explosive energy value for each group based on a representative geologic value for each group comprises determining a target emulsion density value for each group based on the representative geologic value for each group and wherein the target explosive energy profile comprises a target emulsion explosive density profile, and further comprising determining a maximum number of density changes achievable by delivery system equipment, a control system, or both.

7. The method of delivering explosives of claim 6, wherein determining the maximum number of density changes achievable by the delivery system equipment comprises evaluating the following: parameters of a blasthole, flow rate of delivery system equipment, and control system for the delivery system equipment.

8. A method of delivering explosives comprising:

receiving dimensions of a blasthole;

determining any change points within a geologic profile;

segmenting the geologic profile into one or more groups separated by any identified change points;

determining a target explosive energy value for each group based on a representative geologic value for each group, thereby generating a target explosive energy profile comprising target explosive energy values for each group, wherein determining a target explosive energy value for each group based on a representative geologic value for each group comprises determining a target emulsion density value for each group based on the representative geologic value for each group and wherein the target explosive energy profile comprises a target emulsion explosive density profile, and further comprising determining a maximum number of density changes achievable by delivery system equipment, a control system, or both; and delivering an explosive with explosive energy values according to the target explosive energy profile.

9. The method of delivering explosives of claim 8, wherein the wherein the geologic profile comprises geologic values representing geologic characteristics along a length of the blasthole.

10. The method of delivering explosives of claim 8, wherein the wherein the geologic profile comprises geologic values representing geologic characteristics along a blast pattern.

11. The method of delivering explosives of claim 8, wherein determining the maximum number of density changes achievable by the delivery system equipment comprises evaluating the following: parameters of a blasthole, flow rate of delivery system equipment, and control system for the delivery system equipment.

12. A method of delivering explosives comprising:

receiving dimensions of a blasthole;

determining any change points within a geologic profile;

segmenting the geologic profile into one or more groups separated by any identified change points;

determining a target explosive energy value for each group based on a representative geologic value for each group, thereby generating a target explosive energy profile comprising target explosive energy values for each group, wherein determining a target explosive energy value for each group based on a representative geologic value for each group comprises determining a target emulsion density value for each group based on the representative geologic value for each group and wherein the target explosive energy profile comprises a target emulsion explosive density profile; and delivering an explosive with explosive energy values according to the target explosive energy profile.

13. The method of delivering explosives of claim 12, wherein the wherein the geologic profile comprises geologic values representing geologic characteristics along a length of the blasthole.

14. The method of delivering explosives of claim 12, wherein the wherein the geologic profile comprises geologic values representing geologic characteristics along a blast pattern.

15. The method of delivering explosives of claim 12, wherein determining any change points comprises:

calculating a cumulative difference between actual geologic values and a mean of the geologic values; and determining a first peak value of the cumulative difference.

16. The method of delivering explosives of claim 12, further comprising comparing the first peak value to statistical noise in the actual geologic values and identifying the first peak value as a change point if the first peak value exceeds statistical noise.

17. The method of delivering explosives of claim 12, wherein comparing the first peak value to statistical noise in the actual geologic values and identifying the first peak value as a change point if the first peak value exceeds statistical noise comprises: randomizing the actual geologic values to generate a plurality of randomly ordered geologic profiles; calculating a cumulative difference and peak value for each of the plurality of randomly ordered geologic profiles; determining the percentage of random peak values that exceed the first peak value; and identifying the first peak value as a change point if the percentage is less than a selected confidence value.

* * * * *